US011367380B2

(12) United States Patent
Yamanaka et al.

(10) Patent No.: US 11,367,380 B2
(45) Date of Patent: Jun. 21, 2022

(54) DISPLAY DEVICE USING BINARY DRIVER HAVING SEVERAL HOLDING CIRCUITS

(71) Applicant: SHARP KABUSHIKI KAISHA, Sakai (JP)

(72) Inventors: Hidekazu Yamanaka, Sakai (JP); Yuhichiroh Murakami, Sakai (JP); Shuji Nishi, Sakai (JP); Shige Furuta, Sakai (JP); Takahiro Yamaguchi, Sakai (JP); Yasushi Sasaki, Sakai (JP); Satoshi Fujii, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/235,665

(22) Filed: Apr. 20, 2021

(65) Prior Publication Data

US 2021/0335207 A1 Oct. 28, 2021

(30) Foreign Application Priority Data

Apr. 28, 2020 (JP) ..... JP2020-079658

(51) Int. Cl.
*G09G 3/20* (2006.01)

(52) U.S. Cl.
CPC ... *G09G 3/2092* (2013.01); *G09G 2300/0842* (2013.01); *G09G 2310/0286* (2013.01); *G09G 2310/04* (2013.01); *G09G 2310/08* (2013.01)

(58) Field of Classification Search
CPC ..... G09G 3/2092; G09G 3/32; G09G 3/3208; G09G 3/3225–3291; G09G 2300/08; G09G 2300/0809; G09G 2300/0842; G09G 2300/0847; G09G 2300/0857; G09G 2310/02–0208; G09G 2310/0243; G09G 2310/0251; G09G 2310/0264; G09G 2310/027–0275; G09G 2310/0286; G09G 2310/04–063; G09G 2310/08
See application file for complete search history.

(56) References Cited

U.S. PATENT DOCUMENTS 5,345,250 A * 9/1994 Inoue ..... G09G 3/3629 345/100
2004/0008177 A1* 1/2004 Ahn ..... G09G 3/3406 345/102
2010/0128019 A1* 5/2010 Harada ..... G09G 3/3611 345/212
2010/0295841 A1 11/2010 Matsuda et al.

FOREIGN PATENT DOCUMENTS

JP 2012-194582 A 10/2012

* cited by examiner

*Primary Examiner* — Nathan Danielsen
(74) *Attorney, Agent, or Firm* — ScienBiziP, P.C.

(57) ABSTRACT

A display device includes a pixel unit, a binary driver, and a timing generator. The display device is an active matrix display device configured to receive a data signal including image data and other data different from the image data. The pixel unit includes a memory configured to store the image data. The binary driver includes a first holding circuit configured to hold the image data and at least one second holding circuit configured to hold the other data. The timing generator is configured to generate a drive signal used for driving the binary driver.

15 Claims, 31 Drawing Sheets

- Related Art -

- Related Art -

- Related Art -

- Related Art -

- Related Art -

- Related Art -

- Related Art -

- Related Art -

- Related Art -

- Related Art -

- Related Art -

- Related Art -

DISPLAY DEVICE USING BINARY DRIVER HAVING SEVERAL HOLDING CIRCUITS

CROSS-REFERENCE TO RELATED APPLICATIONS

This application claims the benefit of priority to Japanese Patent Application Number 2020-079658 filed on Apr. 28, 2020. The entire contents of the above-identified application are hereby incorporated by reference.

BACKGROUND

Technical Field

The disclosure relates to a display device.

A display device, which is an active matrix display device in which image data is included in serial delta and supplied to a display driver by serial transmission, is disclosed in JP 2012-194582 A. In the display device, a first flag indicating whether to write the image data to a pixel in the frame is added to the serial data for each frame, and the display driver extracts the first flag and the image data from the serial data using a timing of a serial clock transmitted by a wiring line different from the serial data used for the serial transmission, generates a mode signal that changes from a first logical value to a second logical value in the frame when the flag indicates that the image data is written to the pixel, uses a timing of the serial clock to generate a timing signal as a clock signal for operating a shift register of a data signal line drive provided in the display driver, generates a timing signal for a first horizontal period of one frame period from a timing when the mode signal changes from the first logical value to the second logical value and a timing signal as a clock signal for operating the shift register, and inputs the generated timing signal to the shift register of the data signal line driver.

SUMMARY

In the display device disclosed in JP 2012-194582 A, the configuration of the timing generator that generates the operation timing signals (clock signal, start pulse, and the like) of the holding circuit that holds the various data becomes relatively complicated. Consequently, there are problems that the circuit scale of the timing generator increases, and the period required for designing the timing generator increases. Further, since the design of various data holding circuits is required individually, there is a problem that the design period is increased.

One aspect of the disclosure intends to reduce the circuit scale and design period of a timing generator.

In order to solve the above-described problems, a display device according to an aspect of the disclosure, which is an active matrix display device configured to receive a data signal including image data and other data different from the image data, has a configuration including a pixel unit including a memory configured to store the image data, a binary driver including a first holding circuit configured to hold the image data and at least one second holding circuit configured to hold the other data, and a timing generator configured to generate a drive signal used for driving the binary driver.

According to one aspect of the disclosure, it is possible to reduce the circuit scale and design period of the timing generator.

BRIEF DESCRIPTION OF DRAWINGS

The disclosure will be described with reference to the accompanying drawings, wherein like numbers reference like elements.

FIGS. 22A and 22B are arranged one above the other.

DESCRIPTION OF EMBODIMENTS

First Embodiment

Configuration of Display Device 1

Figure 1:
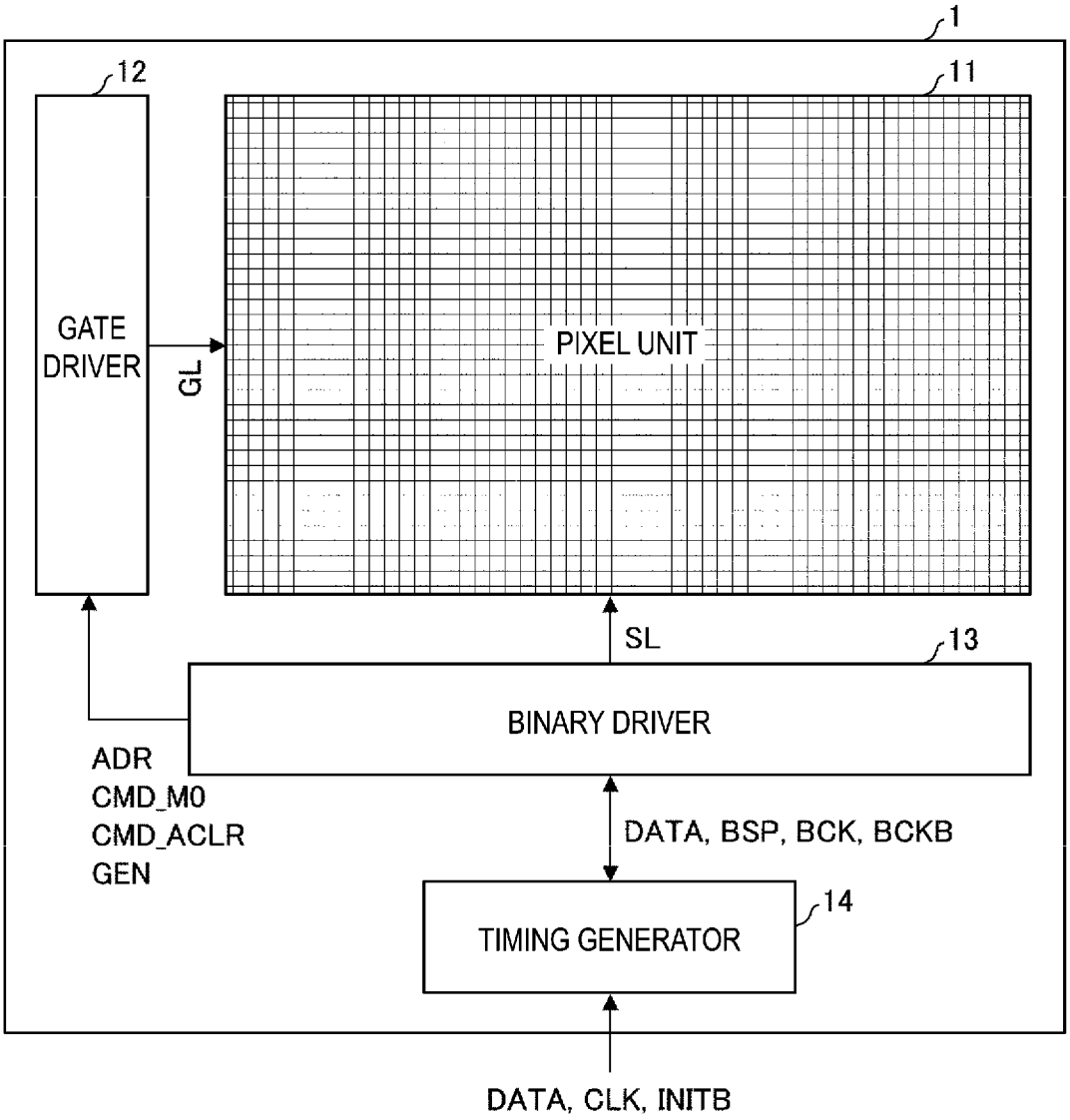
FIG. 1 is a diagram illustrating an overall configuration of a display device according to a first embodiment of the disclosure.

FIG. 1 is a diagram illustrating an overall configuration of a display device 1 according to a first embodiment of the disclosure. The display device 1 is achieved as various display devices having a display function, such as a liquid crystal display device and an organic electroluminescence (EL) display device. As illustrated in FIG. 1, the display device 1 includes a pixel unit 11, a gate driver 12, a binary driver 13, and a timing generator 14. The pixel unit 11 is an active matrix pixel unit including at least a plurality of pixels, a plurality of gate lines, and a plurality of source lines. The pixel unit 11 is also a pixel unit having a static random access memory (SRAM) configuration. The gate driver 12 supplies a gate signal GL to each gate line of the pixel unit 11. The binary driver 13 supplies a binary source signal SL to each source line of the pixel unit 11. The timing generator 14 provides the binary driver 13 with a data signal DATA containing an image data and at least one other data different from the image data. The timing generator 14 receives the data signal DATA together with a clock CLK and a chip select signal INITB from a host device such as a central processing unit (CPU) provided outside the display device 1. The transmission method of each signal from the host device to the timing generator 14 is serial transmission or parallel transmission.

In the present embodiment, a data width of the data signal DATA transmitted from the host device for each clock is the same as a data width of the binary driver 13. However, the data width of the data signal DATA transmitted for each clock is not limited thereto, and may be smaller than the data width of the binary driver 13. In this example, the display device 1 further includes a conversion circuit that converts the data width of the data signal DATA by, for example, a serial-parallel conversion method, at the inlet of the timing generator 14. In this example, the display device 1 further includes a clock frequency-dividing circuit that outputs a pulse each time the data signal. DATA corresponding to the data width of the binary driver 13 is collected, at the inlet of the timing generator 14. Then, the display device 1 supplies the data signal DATA converted to the same data width as the data width of the binary driver 13 and the frequency-divided clock signal, as the data signal DATA and the clock signal for the circuit after the binary driver 13.

Figure 2:
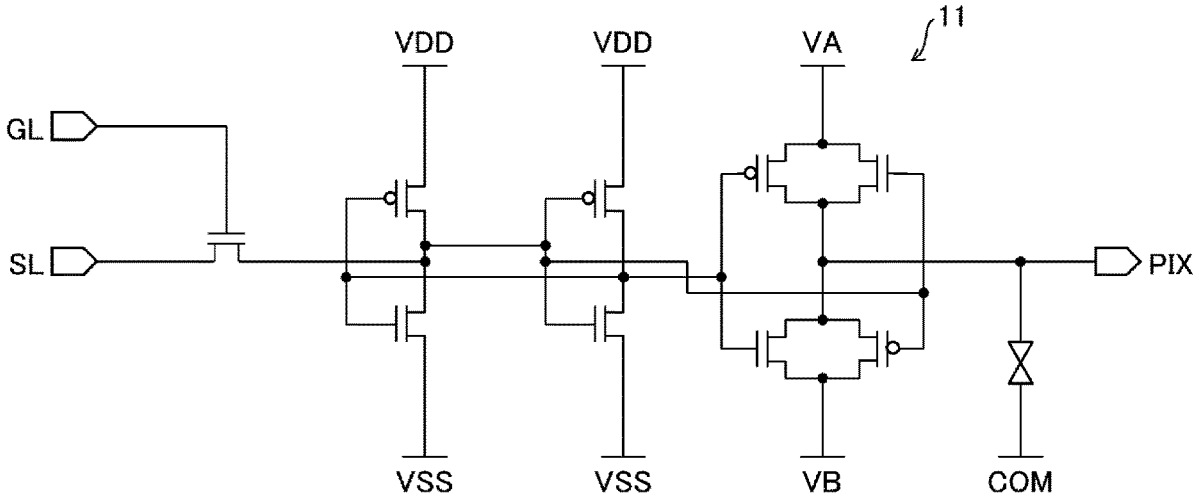
FIG. 2 is a diagram illustrating an example of a circuit configuration of one pixel provided in a pixel unit according to the first embodiment of the disclosure.
Figure 3:
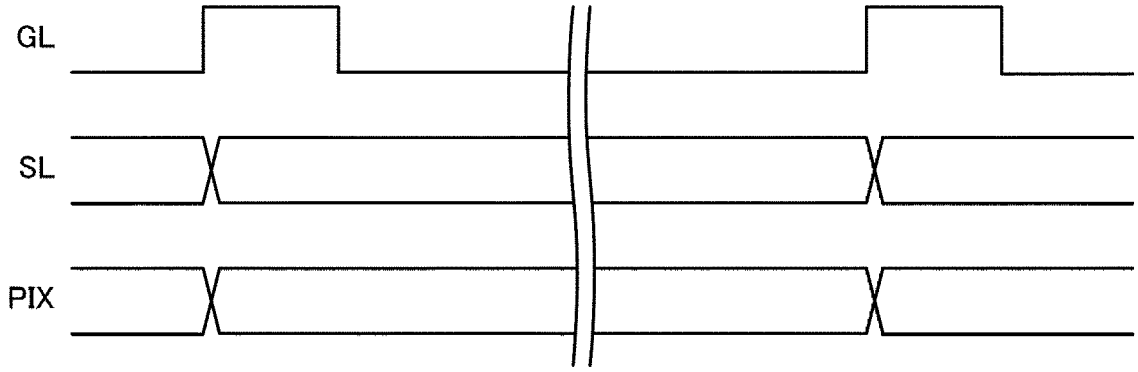
FIG. 3 is a timing chart illustrating an operation of a pixel circuit included in the pixel unit according to the first embodiment of the disclosure.

FIG. 2 is a diagram illustrating an example of a circuit configuration of one pixel provided in the pixel unit 11 according to the first embodiment of the disclosure. FIG. 3 is a timing chart illustrating an operation of the pixel circuit included in the pixel unit 11 according to the first embodiment of the disclosure. Each pixel of the pixel unit 11 is configured as a pixel circuit of a memory (SRAM). The gate signal GL and the source signal SL are inputted to the pixel circuit. When the gate signal GL becomes high potential (H potential), the source signal SL is inputted to the pixel circuit. In this way, the SL signal is stored in the pixel circuit. When the gate signal GL becomes low potential (L potential), the state in the pixel circuit is fixed. A potential VA or a potential VB is constantly outputted to a pixel electrode PIX. In the example of FIG. 2, a switch for the gate line is a negative-channel metal oxide semiconductor (NMOS) switch. The switch for the gate line is not limited thereto, and may have a complementary metal oxide semiconductor (CMOS) switch configuration. In the example of FIG. 2, a switch for the potential VA and a switch for the potential VB are the CMOS switches. These switches are not limited thereto, and may be NMOS switches. In the pixel unit 11, the pixel circuits illustrated in FIG. 2 are arranged in a matrix.

Figure 4:
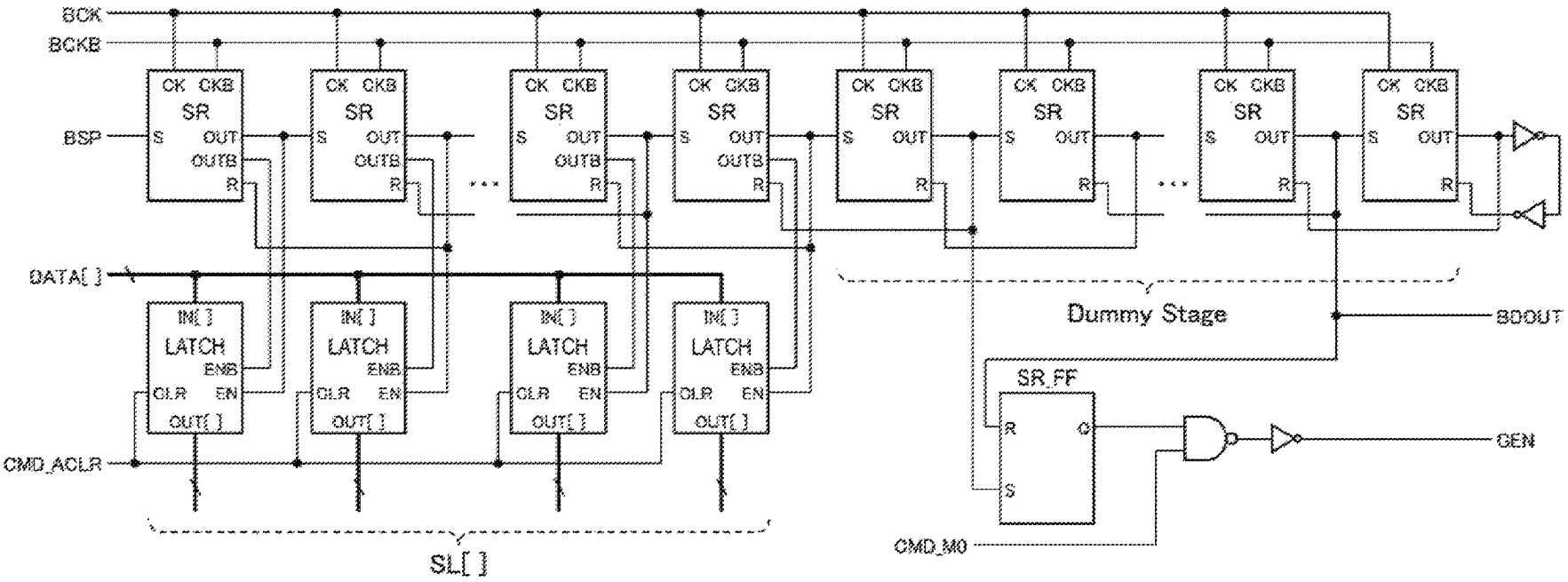
FIG. 4 is a diagram illustrating an example of a configuration of a binary driver according to the related art.
Figure 5:
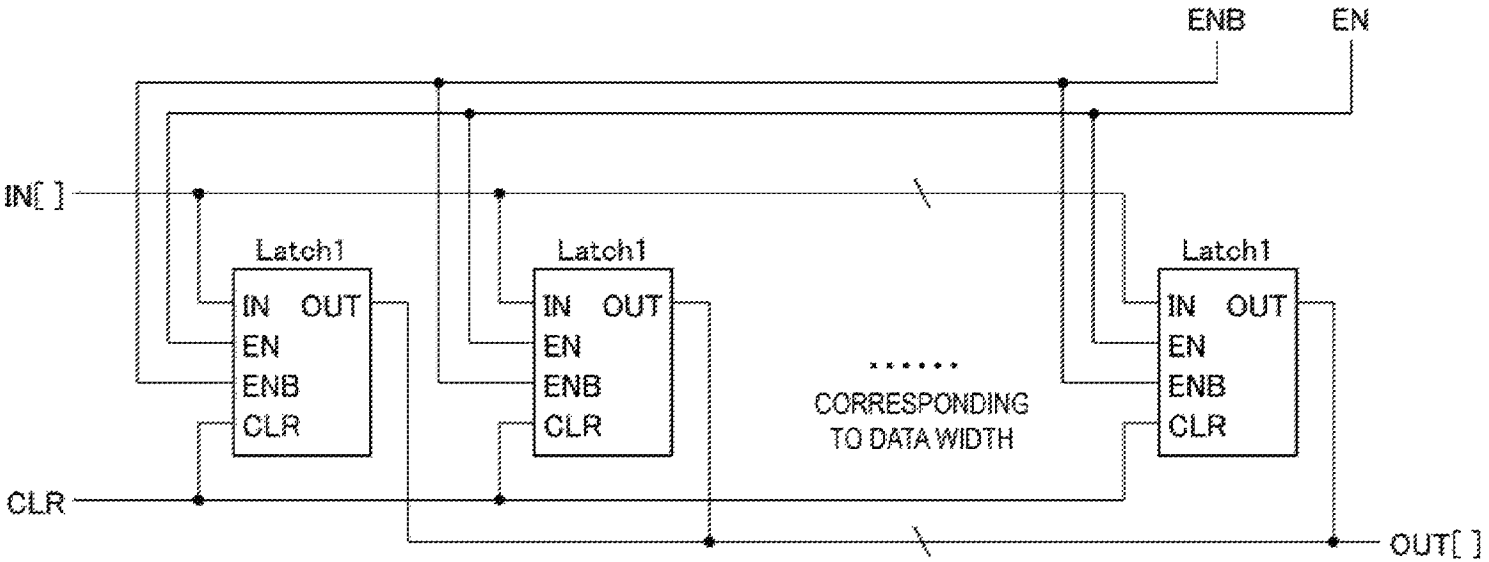
FIG. 5 is a diagram illustrating an example of a circuit configuration of one of a plurality of stages of latches included in the binary driver according to the related art.
Figure 6:
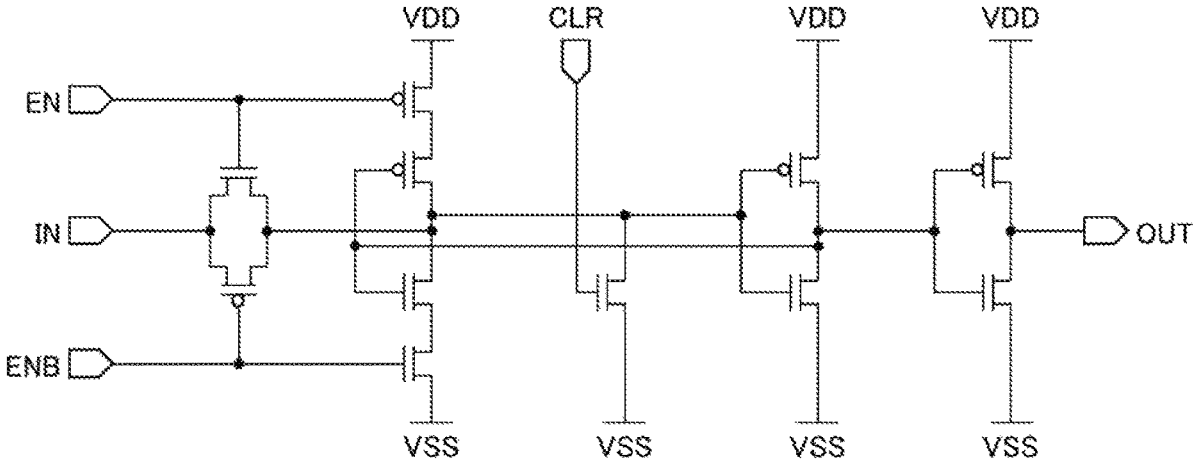
FIG. 6 is a diagram illustrating an example of a circuit configuration of one of a plurality of stages of interior latches constituting one latch according to the related art.
Figure 7:
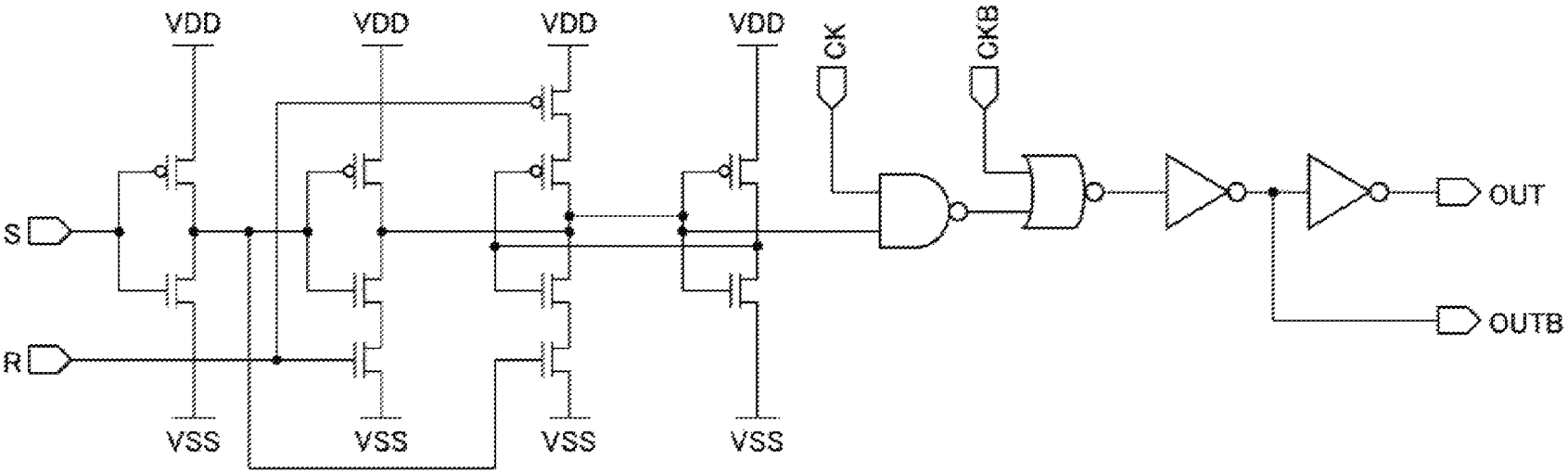
FIG. 7 is a diagram illustrating an example of a circuit configuration of a shift register included in the binary driver according to the related art.
Figure 8:
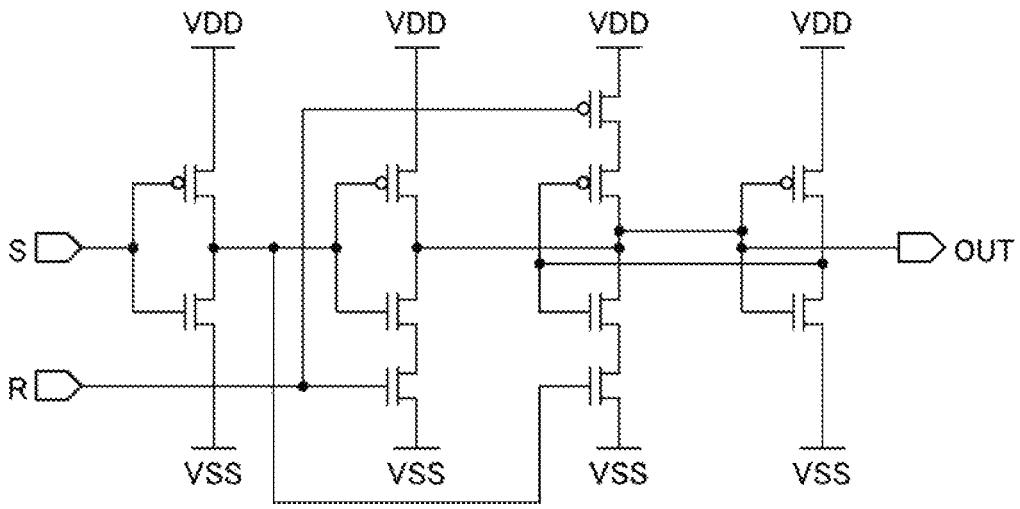
FIG. 8 is a diagram illustrating an example of a circuit configuration of a set-reset flip-flop included in the binary driver according to the related art.

FIG. 4 is a diagram illustrating an example of a configuration of a binary driver according to the related art. Each stage of the binary driver is basically constituted of a shift register and a latch corresponding to a data width. The latch operates the output as a holding control signal. Here, the data width is an integer equal to or greater than 1. FIG. 5 is a diagram illustrating an example of a circuit configuration of one of a plurality of stages of latches included in the binary driver according to the related art illustrated in FIG. 4. FIG. 6 is a diagram illustrating an example of a circuit configuration of one of a plurality of stages of interior latches constituting one latch according to the related art illustrated in FIG. 5. FIG. 7 is a diagram illustrating an example of a circuit configuration of one shift register included in the binary driver according to the related art illustrated in FIG. 4. FIG. 8 is a diagram illustrating an example of a circuit configuration of one set-reset flip-flop included in the binary driver according to the related art illustrated in FIG. 4.

As illustrated in FIG. 4, the shift register in each stage included in the binary driver operates based on a start pulse signal BSP, a clock signal BCK, and a clock signal BCKB supplied from the timing generator. The clock signal BCKB is an inverted signal of the clock signal BCK. The start pulse signal BSP is inputted to an S input of the shift register in a first stage. The clock signal BCK is inputted to a CK input of each shift register in odd-numbered stages and a CKB input of each shift register in even-numbered stages. The clock signal BCKB is inputted to a CKB input of each shift register in odd-numbered stages and a CK input of each shift register in even-numbered stages. The signal outputted from an OUT output of the shift register in the previous stage is inputted to the S input of each shift register in the second and subsequent stages. The signal outputted from the OUT output of the shift register in the subsequent stage is inputted to an R input of each shift register from the first stage to the one stage before the final stage. The signal outputted from the OUT output of the shift register in the final stage is inputted to the R input of the shift register in the final stage.

The period from the rising edge to the falling edge of the clock signal BCK and the period from the rising edge to the falling edge of the clock signal BCKB are both set as one cycle. The shift register in each stage executes a shift operation for each timing of both the rising edge of the clock signal BCK and the falling edge of the clock signal BCKB. Further, the shift register in each stage executes the shift operation for each timing of both the falling edge of the clock signal BCK and the rising edge of the clock signal BCKB. In either case, by the shift operation, pulses are sequentially outputted from the OUT output and the OUTB output of the shift register in each stage. The latch in each stage holds the value of the data signal corresponding to the data width by using each pulse inputted from the corresponding shift register. Consequently, the value of the data signal DATA is held in the latch in each stage at the timing of being sequentially shifted by one cycle from the start pulse signal BSP. All source signals SL are fixed to a low value (L value) regardless of the value of the latched data when a "clear all" flag CMD_ACLR is H.

Each of the rear stages of the circuit illustrated in FIG. 4 is a dummy stage for timing generation, and is constituted only of shift registers that do not have latches. At each rear stage, a signal BDOUT and a signal GEN are generated. The signal BDOUT functions as a trigger for the start pulse BSP to start capturing the next image data. The signal GEN enables the output of the gate signal GL when an "update holding" flag CMD_M0 has the high value (H value). When the CMD_M0 has the L value, the signal GEN is not generated, so that the output of the gate signal GL is not enabled. Accordingly, pixel writing is not performed. The GEN signal becomes valid at the timing of the stages from the first stage to the one stage before the final stage in the dummy stages. Not limited to this timing, the GEN signal may be valid at a timing different from this timing.

Figure 9:
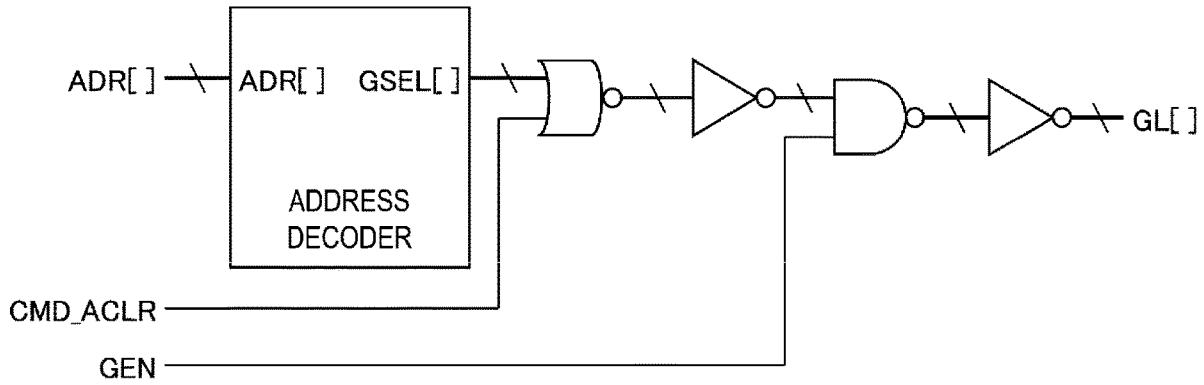
FIG. 9 is a diagram illustrating an example of a circuit configuration of a gate driver according to the first embodiment of the disclosure.

FIG. 9 is a diagram illustrating an example of a circuit configuration of the gate driver 12 according to the first embodiment of the disclosure. The gate driver 12 receives an address signal ADR[ ] from the binary driver 13 and binary decodes the address signal ADR[ ] to generate a binary decoded signal GSEL[ ]. The gate driver 12 sets the gate signal GL selected by the binary decoded signal GSEL[ ] to the H value while the GEN signal has the H value. When the CMD_ACLR has the H value, the gate driver 12 selects all the gate signals GL. The gate driver 12 sets all the gate signals GL to the H values while the GEN signal has the H value. At this time, since the binary driver 13 sets all the source signals SL to the L values, the L values are written to all the pixels. In this way, the gate driver 12 generates the gate signal GL by binary decoding the address signal ADR[ ]. Not limited thereto, the gate driver 12 may generate the gate signal GL by a gate scanning circuit.

Figure 10:
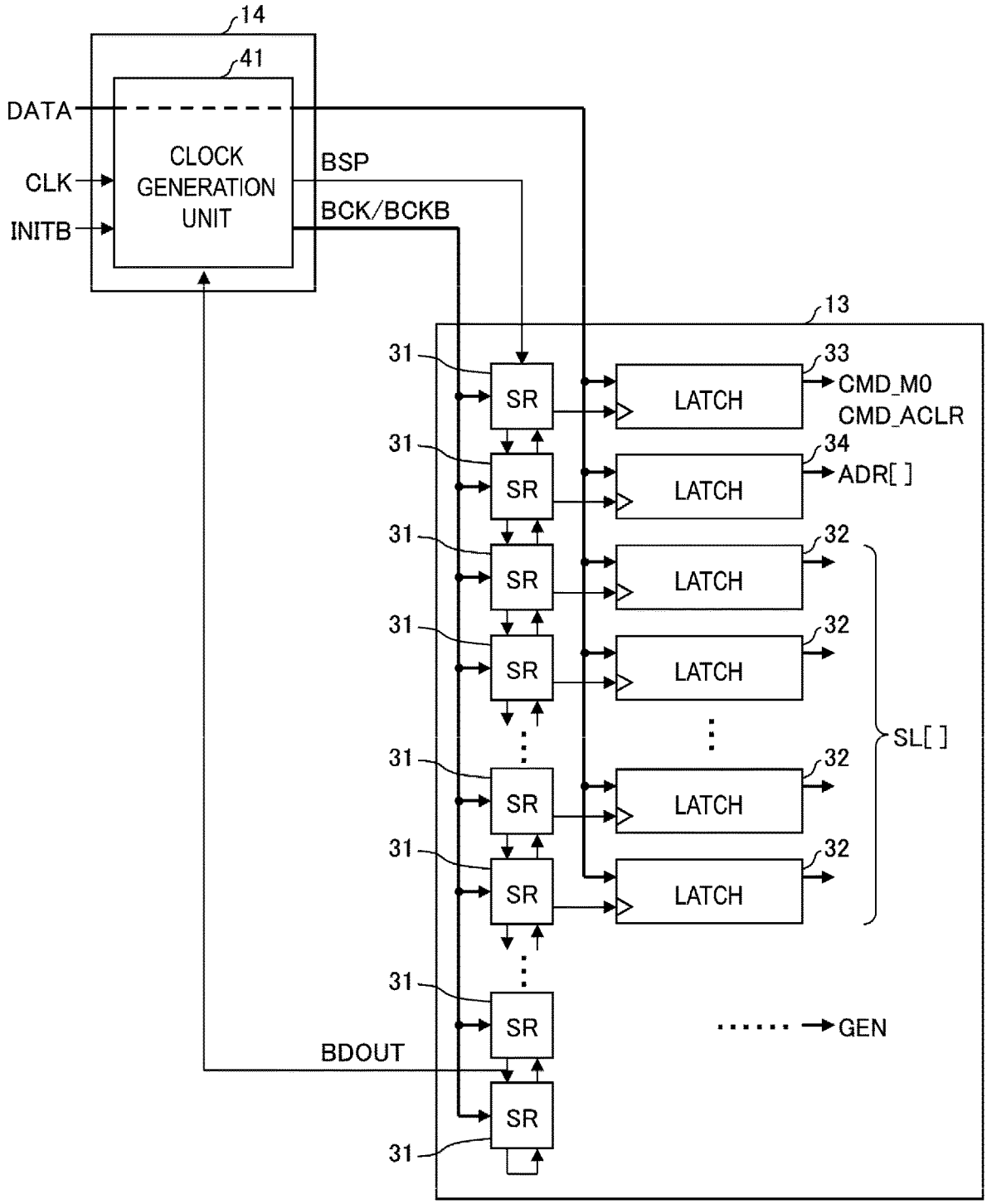
FIG. 10 is a block diagram illustrating a configuration of main portions of a binary driver and a timing generator according to the first embodiment of the disclosure.

FIG. 10 is a block diagram illustrating a configuration of main portions of the binary driver 13 and the timing generator 14 according to the first embodiment of the disclosure. As illustrated in this figure, the timing generator 14 includes a clock generation unit 41. As illustrated in FIG. 10, the timing generator 14 receives the data signal DATA together with the clock CLK and the chip select signal INITB from the host device such as the CPU provided outside the display device 1. The data signal DATA includes image data D1 to Dn (n is a positive integer), and command data (flag) CMD and address data ADR that are different from the image data D1 to Dn. The command data CMD is data that specifies the operation of the display device 1. Specifically, the command data CMD is data that specifies any one of an update operation, a holding operation, and a "clear all" operation of the image data D1 to Dn. The address data ADR is data that specifies a line in which the image data D1 to Dn are written in the pixel unit 11. The transmission method of each signal from the host device to the timing generator 14 is serial transmission or parallel transmission. In the present embodiment, the timing generator 14 receives each signal having the same data width as the data width of the binary driver 13 by the parallel transmission, and outputs a drive signal for driving the binary driver 13 together with the data signal DATA having the same data width as the data width of the binary driver 13 to the binary driver 13.

As illustrated in FIG. 10, the binary driver 13 includes a plurality of shift registers 31, a plurality of latches 32 (first holding circuit), a latch 33 (second holding circuit), and a latch 34 (second holding circuit). In the example illustrated in FIG. 10, it is assumed that the number of the plurality of shift registers 31 is m (m is an integer greater than n). The plurality of shift registers 31 constitute a plurality of stages of shift registers. The latches 32 to 34 constitute a plurality of stages of latches.

The first latch 33 to the final stage (mth stage) latch 32 output, in order, signals OUT1, OUT2, OUT3, . . . OUTm, respectively. The latch 33 and the latch 34 are arranged in the stages in front of the latches 32. More specifically, the latch 33 and latch 34 are incorporated in the binary driver 13 as the latches in the first two stages (first stage and second stage) among the latches in the respective stages in the binary driver 13. The circuit configurations of the latches 33 and 34 are the same as the circuit configuration of the latch according to the related art illustrated in FIG. 6. The circuit configurations of the shift registers 31 in the first stage and the second stage connected to the latches 33 and 34, respectively, are the same as the circuit configuration of the shift register illustrated in FIG. 7. The configuration of the portion of the binary driver 13 excluding the latches 33 and 34 and the two shift registers 31 connected to the latches 33 and 34 is the same as the configuration of the binary driver illustrated in FIG. 4.

The latch 33 generates the "update holding" flag CMD_M0 and the "clear all" flag CMD_ACLR by using the command data CMD included in the data signal DATA inputted from the timing generator 14. The latch 34 generates the address signal ADR[ ] by using the address data ADR included in the data signal DATA inputted from the timing generator 14. The data width of the latch 33 may be the same as the data widths of the latches 32 in the other stages. Alternatively, the data width of the latch 32 may be a required data width according to the data width of the command data CMD that the latch 33 needs to hold. The data width of the latch 34 may be the same as the data width of the latches 32 in the other stages. Alternatively, the data width of the latch 34 may be a required data width according to the data width of the address data ADR that the latch 34 needs to hold.

In the present embodiment, the latch 33 and the latch 34 are incorporated in the binary driver 13. Thus, it is not necessary to separately provide a dedicated latch for holding the command data CMD and a dedicated latch for holding the address data ADR outside the binary driver 13. Further, it is not necessary to provide timing generator 14 with a circuit for generating a clock signal for driving these dedicated latches. Accordingly, as illustrated in FIG. 11, the timing generator 34 generates only the start pulse signal BSP, the clock signal BCK, and the clock signal BCKB as signals for driving the binary driver 13.

Figure 11:
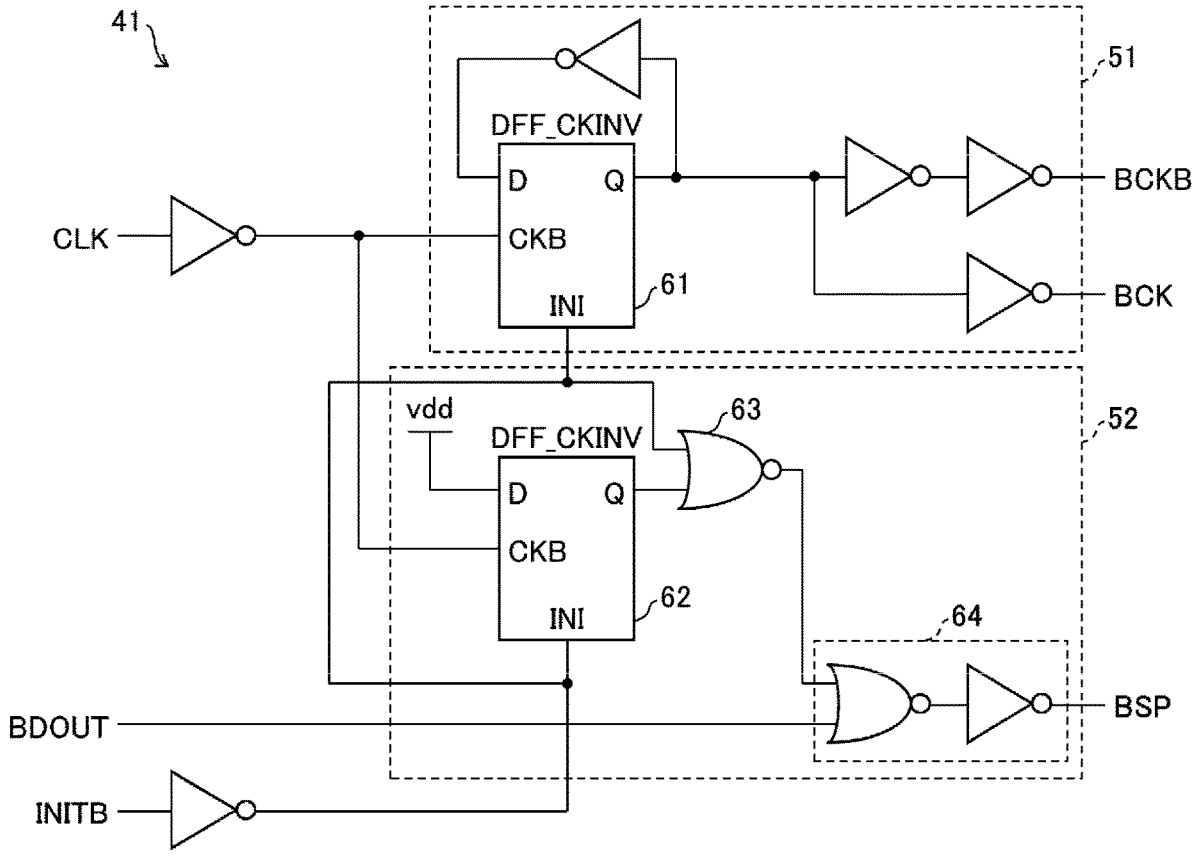
FIG. 11 is a diagram illustrating an example of a circuit configuration of a clock generation unit according to the first embodiment of the disclosure.
Figure 12:
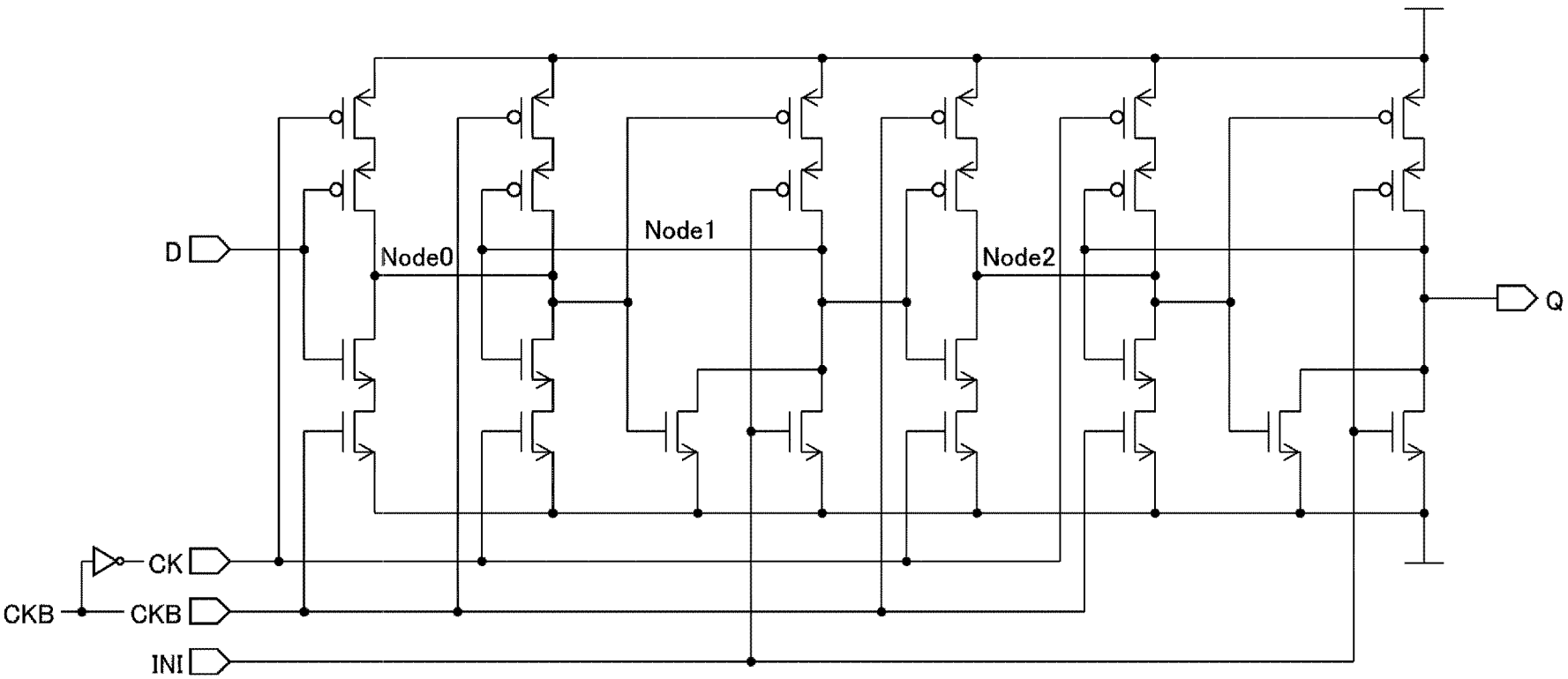
FIG. 12 is a diagram illustrating an example of a circuit configuration of a flip-flop according to the first embodiment of the disclosure.

FIG. 11 is a diagram illustrating an example of a circuit configuration of the clock generation unit 41 according to the first embodiment of the disclosure. As illustrated in FIG. 11, the clock generation unit 41 mainly includes two functional portions 51 and 52. The functional portion 51 is a portion for generating the clock signal BCK and the clock signal BCKB for the binary driver 13. The functional portion 52 is a portion for generating the start pulse BSP for the binary driver 13. The functional portion 51 mainly includes a flip-flop 61. The functional portion 52 mainly includes a flip-flop 62, a logic circuit 63, and an OR logic circuit 64. The flip-flops 61 and 62 are connected in series with each other. Both the flip-flops 61 and 62 are flip-flops with a reset INI that captures data at the falling edge of the clock signal CKB. FIG. 12 is a diagram illustrating an example of a circuit configuration of the flip-flop 61 or 62 according to the first embodiment of the disclosure. The circuit configuration itself illustrated in FIG. 12 is a common circuit configuration in which two stages of latches connected in series are operated at the falling and rising edges of the clock signal CLK, respectively.

The flip-flop 61 inverts a signal outputted from an output Q and inputs the inverted signal to an input D. The functional portion 51 toggles a value of the output Q for each rising edge of the clock signal CLK by using the flip-flop 61. The functional portion 51 outputs a signal from the output Q by frequency-dividing the inputted clock signal CLK to two. Consequently, the functional portion 51 outputs a signal having the same phase as the signal outputted from the output Q to the outside of the clock generation unit 41 as the clock signal BCKB. The functional portion 51 further outputs a signal obtained by inverting the signal outputted from the output Q to the outside of the clock generation unit 41 as the clock signal BCK.

When the chip select INITB is not selected (L value), such as at the initial stage of the timing generator 14, the flip-flop 61 is reset. Thus, the signal outputted from the output Q has also the L value. Consequently, the clock signal BCKB and the clock signal BCK outputted from the clock generation unit 41 have the L value and the H value, respectively. Thereafter, the signal outputted from the output Q and the clock signal BCKB are inverted as the L value, the H value, the L value, and the like in order for each rising edge of the clock signal CLK. On the other hand, the clock signal BCK is inverted as the H value, the L value, the H value, and the like in order.

In the flip-flop 62, the H value (voltage vdd) is fixedly inputted to an input D. The functional portion 52 constitutes a one shot circuit that outputs a signal with the L value from the output Q by using the flip-flop 62 only while the chip select signal INITB is not selected (L value) and until the rise of a first clock signal CLK after the selection of the chip select signal INITB (H value). The logic circuit 63 outputs the H value by being valid only when the signal outputted from the output Q has the L value and the chip select signal INITB has the H value. Since the functional portion 52 includes such a logic circuit 63, the start pulse BSP with the II value is outputted between the time when the chip select signal INITB is selected and the rising edge of the clock signal CLK. The OR logic circuit 64 outputs a signal with the H value when either the signal BDOUT outputted from the binary driver 13 or the signal outputted from the OR logic circuit 64 has the H value as a trigger for starting the acquisition of the next data. The functional portion 52 outputs the signal outputted from the OR logic circuit 64 to the outside of the clock generation unit 41 as the start pulse BSP. In this way, the functional portion 52 outputs the start pulse BSP with the H value for the next data.

Figure 13:
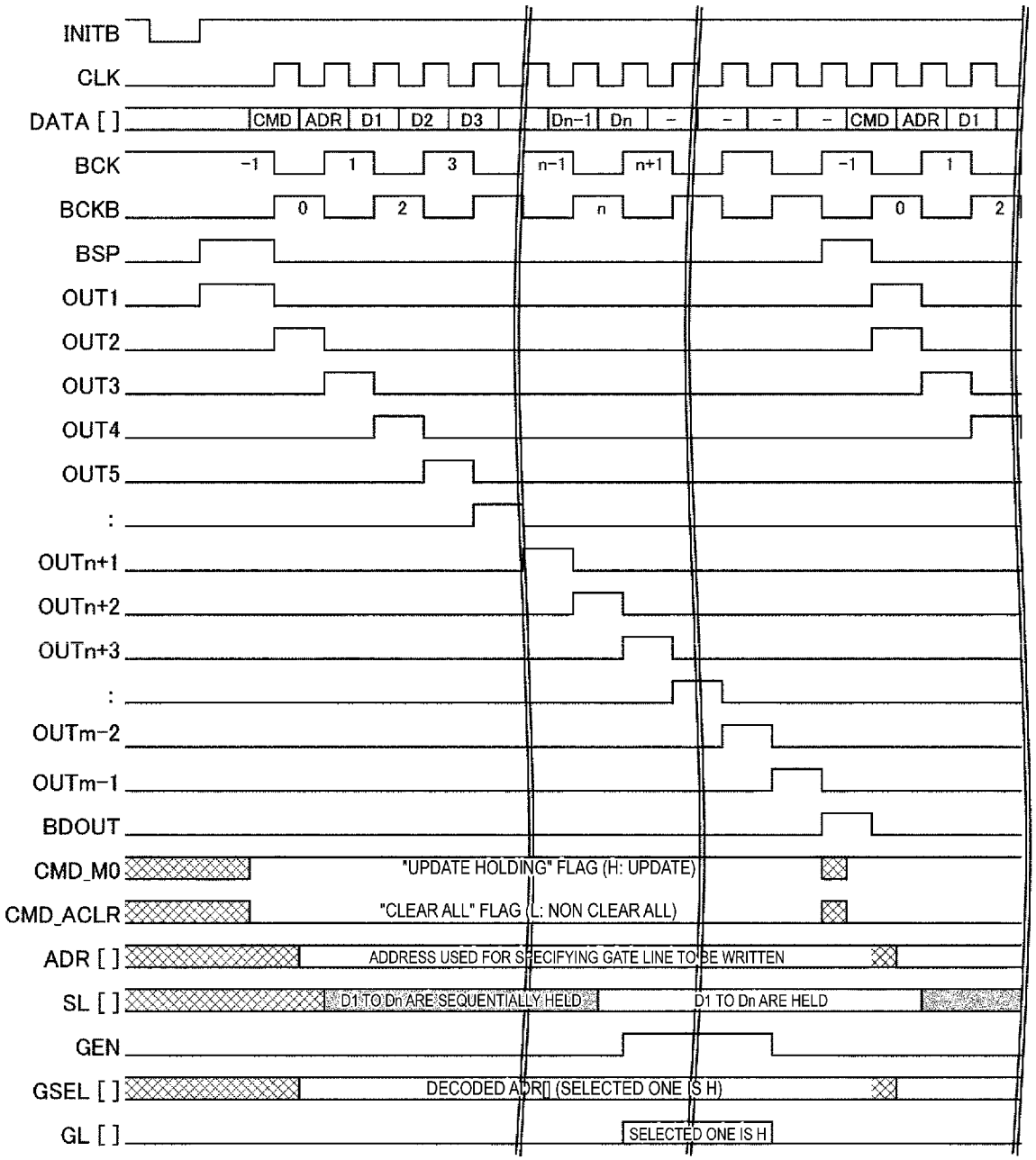
FIG. 13 is a timing chart when the display device according to the first embodiment of the disclosure executes data update.
Figure 14:
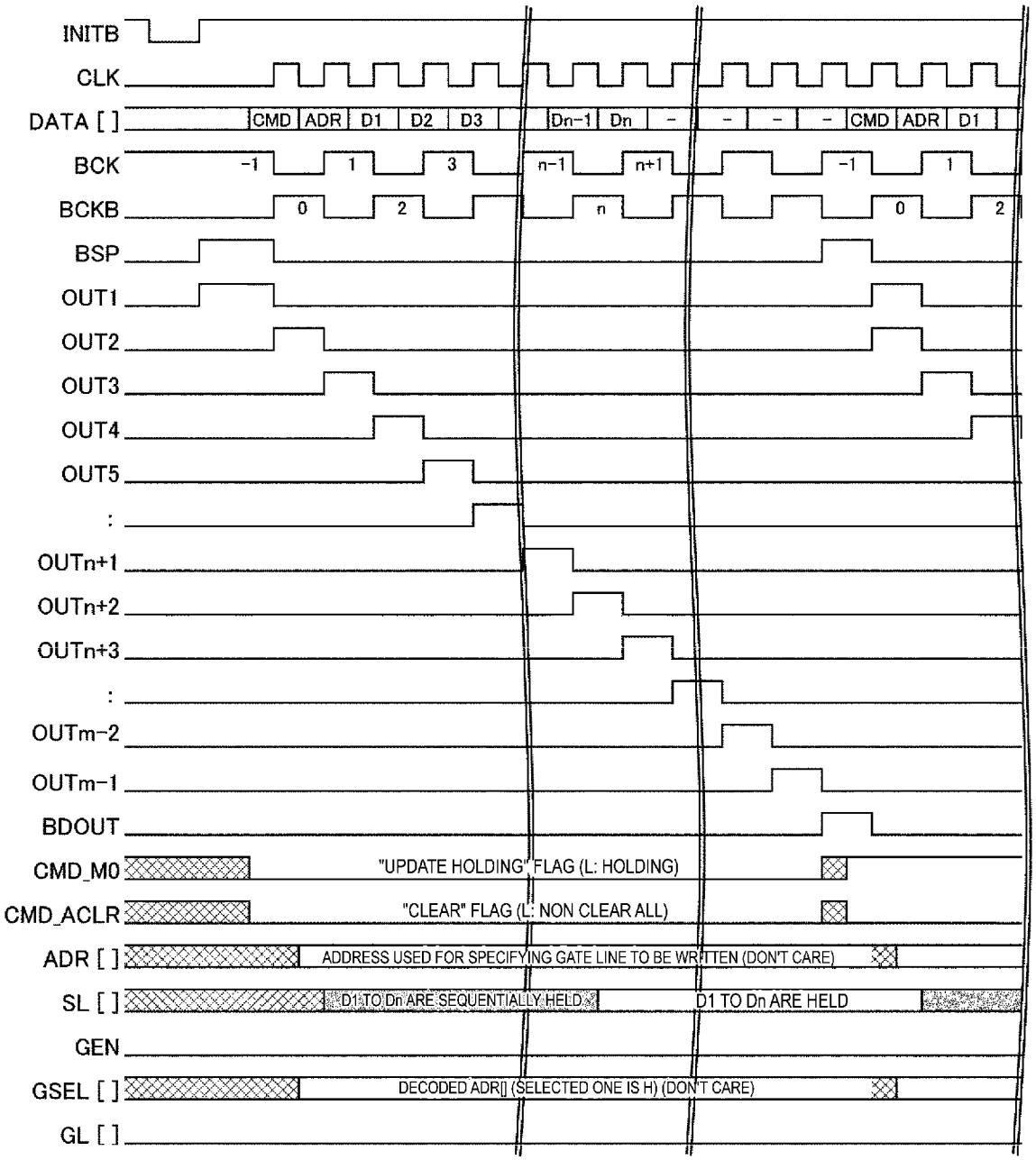
FIG. 14 is a timing chart when the display device according to the first embodiment of the disclosure executes data holding.
Figure 15:
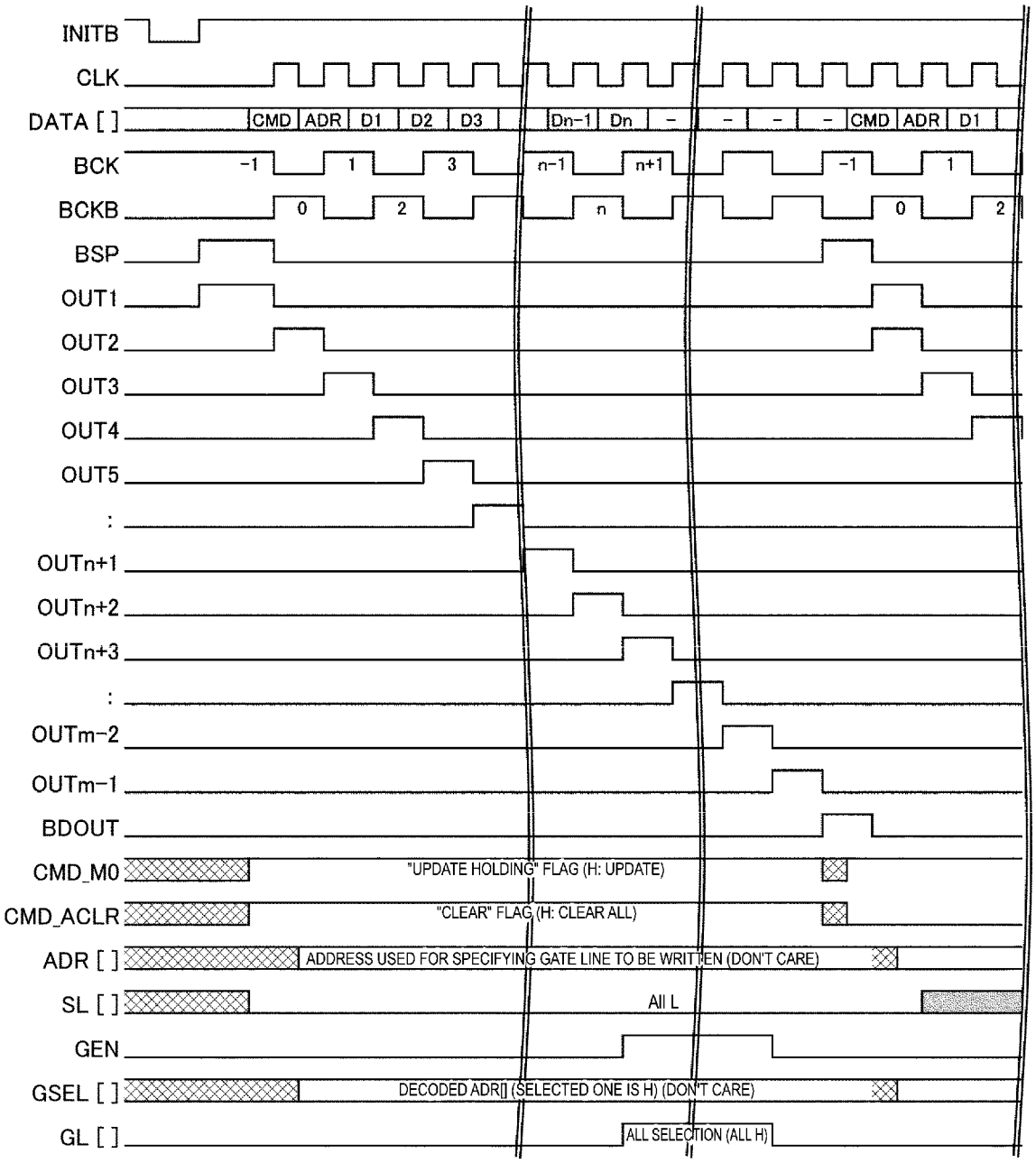
FIG. 15 is a timing chart when the display device according to the first embodiment of the disclosure executes "clear" for all data.

FIG. 13 is a timing chart when the display device 1 according to the first embodiment of the disclosure executes data update. FIG. 14 is a timing chart when the display device 1 according to the first embodiment of the disclosure executes data holding. FIG. 15 is a timing chart when the display device 1 according to the first embodiment of the disclosure executes "clear" for all data. The clock generation unit 41 generates and outputs the start pulse signal BSP between the timing when the chip select signal INITB is outputted and the timing when the first clock signal CLK outputted after the chip select signal INITB is outputted. More specifically, as illustrated in FIGS. 13 to 15, the clock generation unit 41 outputs the start pulse signal BSP between the rising edge of the chip select signal INITB and the rising edge of the first clock signal CLK. Consequently, the display device 1 can execute operations according to the clock signal CLK, the chip select signal INITB, and the data signal DATA at the same input timings of the respective signals as the display device 1 of the related art.

The data signal DATA may include data other than the command data CMD and ADR data, which are different from the image data D1 to Dn. In addition, the number of data different from the image data D1 to Dn included in the data signal DATA is not limited to the two described above, and may be one or three or more. Accordingly, the binary driver 13 may incorporate a required number of latches according to the number of data other than the image data D1 to Dn.

Configuration of Related Art

Figure 16:
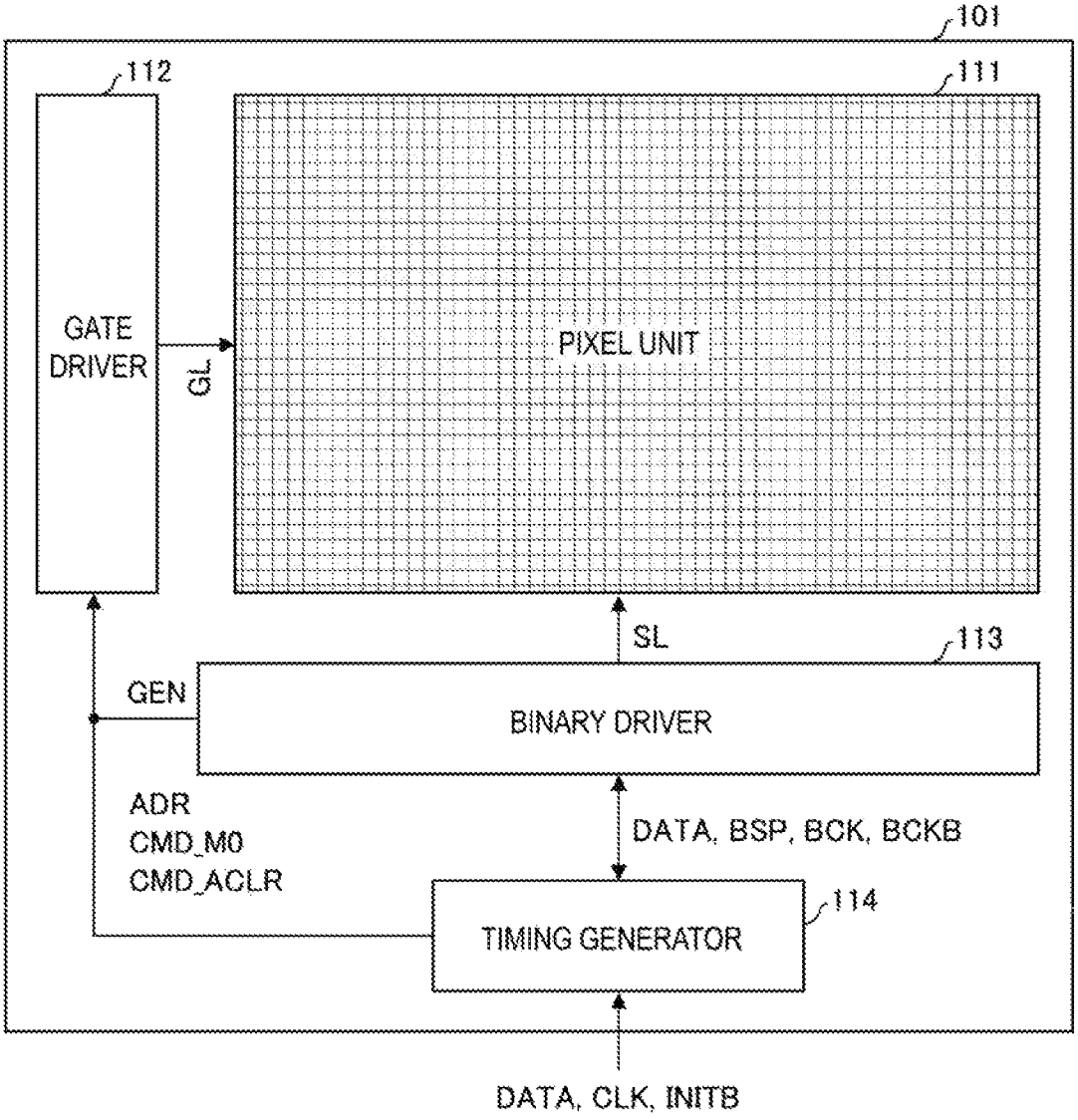
FIG. 16 is a diagram illustrating an overall configuration of a display device according to the related art.
Figure 17:
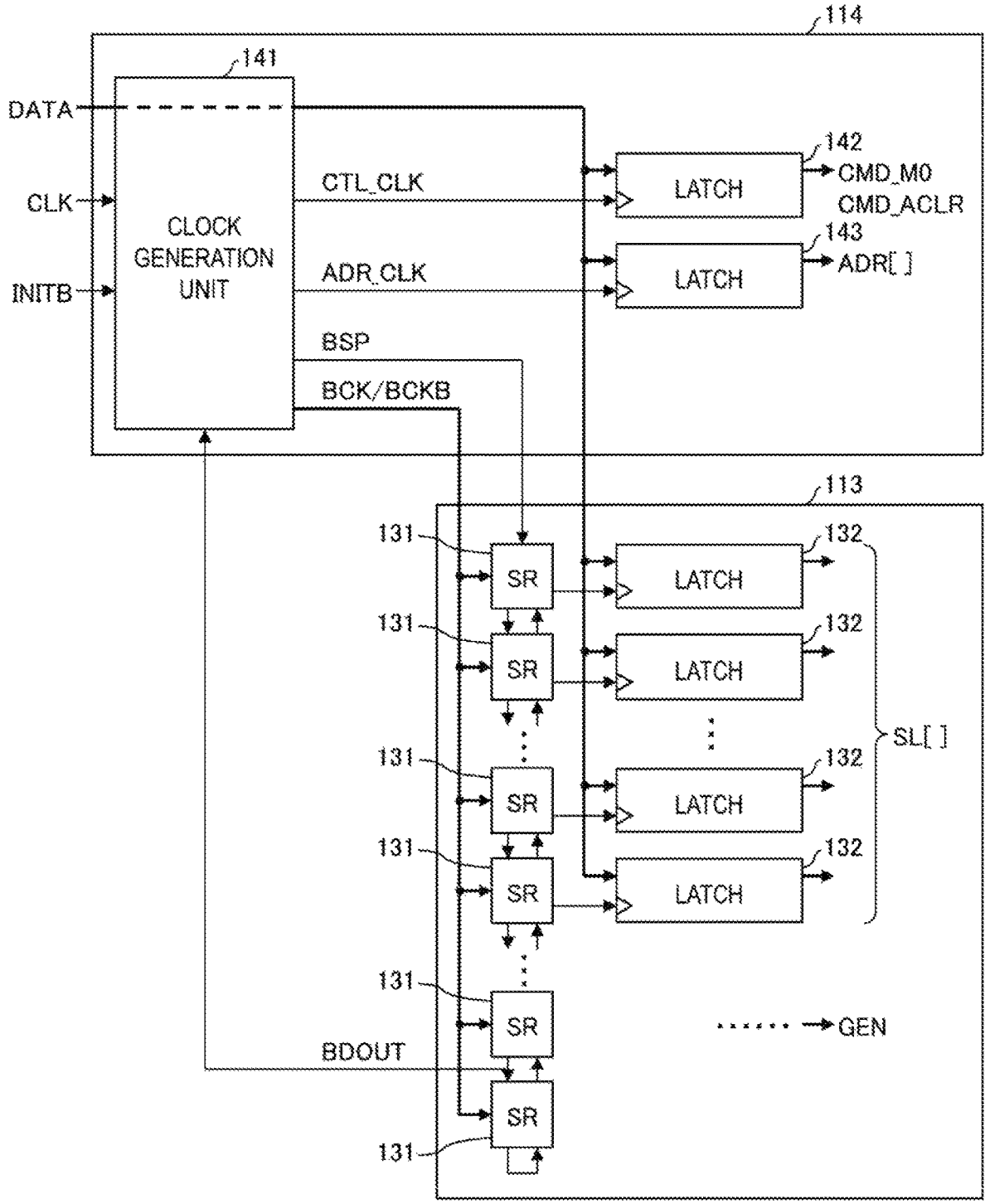
FIG. 17 is a block diagram illustrating a configuration of main portions of the binary driver and a timing generator according to the related art.

For comparison with the first embodiment of the disclosure, a display device 101 according to the related art will be described below with reference to FIGS. 16 to 21. FIG. 16 is a diagram illustrating an overall configuration of the display device 101 according to the related art. As illustrated in FIG. 16, the display device 101 includes a pixel unit 111, a gate driver 112, a binary driver 113, and a timing generator 114. FIG. 17 is a block diagram illustrating a configuration of main portions of the binary driver 113 and the timing generator 114 according to the related art. As illustrated in FIG. 17, the binary driver 113 includes a plurality of shift registers 131 and a plurality of latches 132. The configuration of the binary driver 113 is the same as the configuration of the binary driver according to the related art illustrated in FIG. 4. That is, unlike the binary driver 13 according to the present embodiment, the binary driver 113 does not include a dedicated latch for holding the command data CMD and a dedicated latch for holding the address data ADR.

As illustrated in FIG. 17, the timing generator 114 includes a clock generation unit 141, a latch 142, and a latch 143. The latch 142 generates the "update holding" flag CMD_M0 and the "clear all" flag CMD_ACLR by using the command data CMD included in the data signal DATA. The latch 143 generates the address signal ADR[ ] by using the address data ADR included in the data signal DATA.

The latch 142 and the latch 143 are disposed outside the binary driver 113, and do not adopt a latch repetitive structure together with respective latches 132 in the binary driver 113. Thus, the latch 142 requires a dedicated clock signal CTL_CLK to drive the latch 142, and the latch 143 requires a dedicated clock signal ADR_CLK to drive the latch 143.

Figure 18:
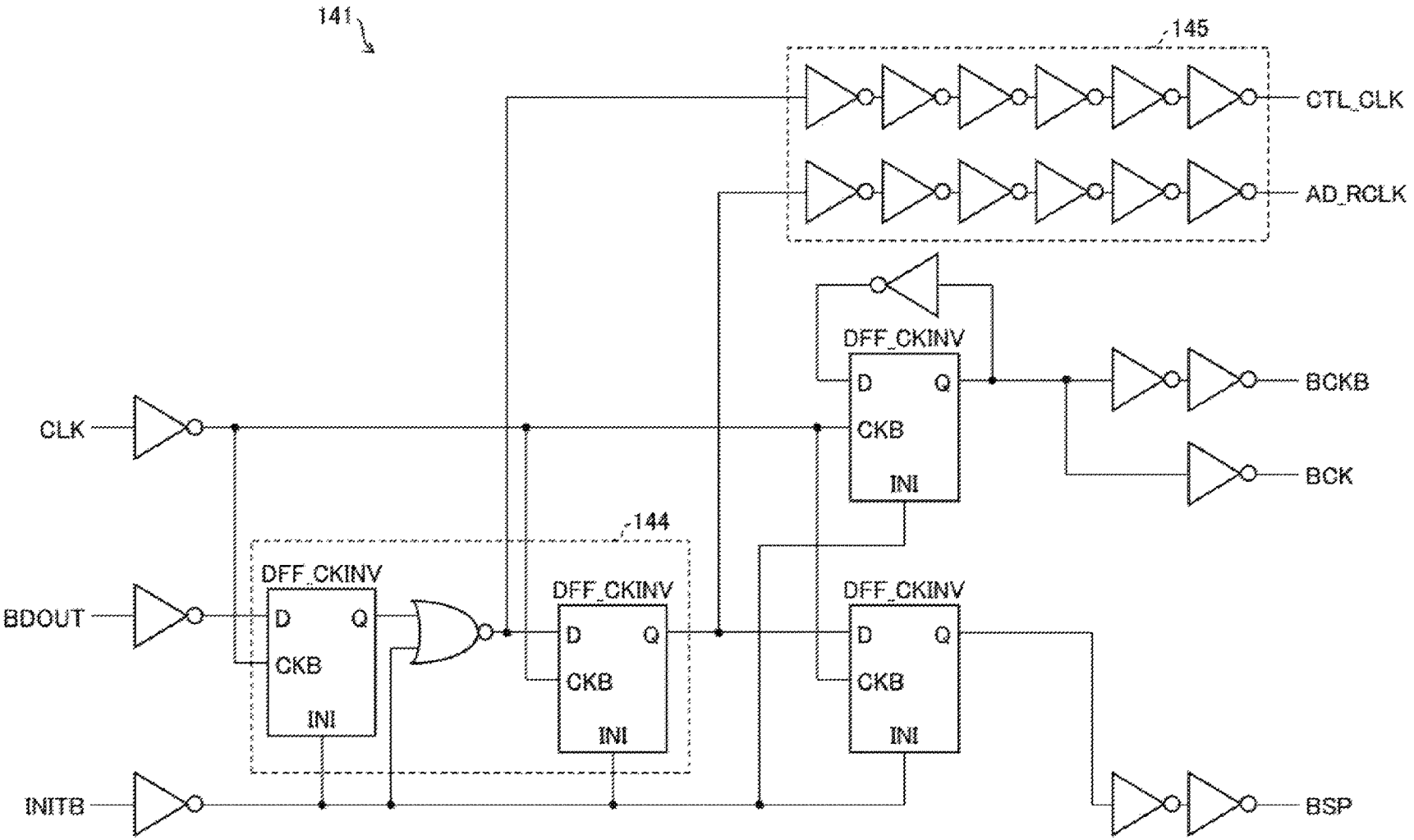
FIG. 18 is a diagram illustrating an example of a circuit configuration of a clock generation unit according to the related art.

FIG. 18 is a diagram illustrating an example of a circuit configuration of the clock generation unit 141 according to the related art. As illustrated in this figure, the clock generation unit 141 includes a circuit 144 for generating the clock signal CTL_CLK and the clock signal ADR_CLK in addition to a circuit for generating the start pulse BSP, the clock signal BCK, and the clock signal BCKB. The clock generation unit 141 further includes a circuit 145 for adjusting the output timing between the clock signal CTL_CLK and the clock signal ADR_CLK. With this configuration, the clock generation unit 141 generates the clock signal CTL_CLK and the clock signal ADR_CLK in addition to the start pulse BSP, the clock signal BCK, and the clock signal BCKB.

Figure 19:
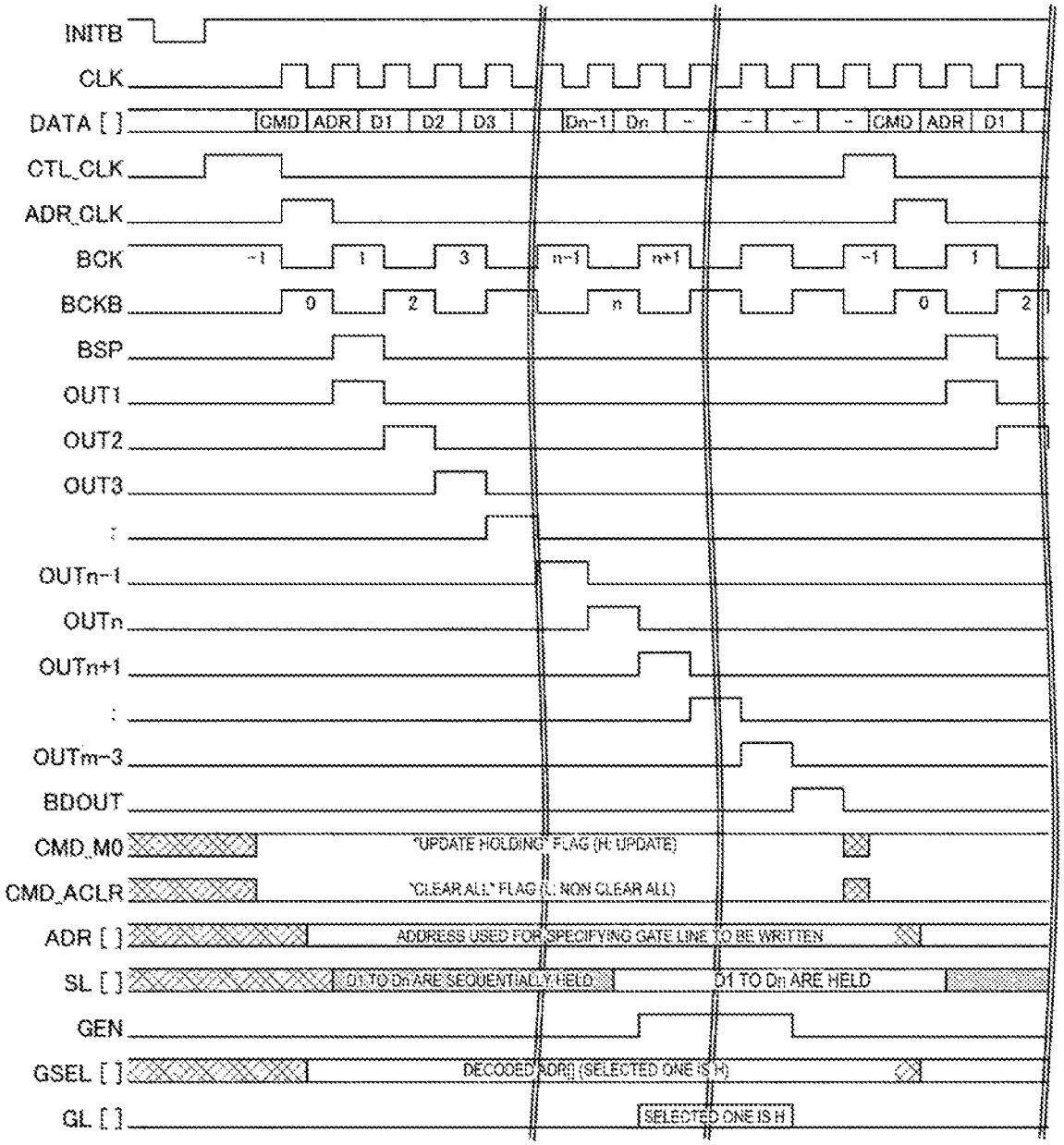
FIG. 19 is a timing chart when the display device according to the related art executes data update.
Figure 20:
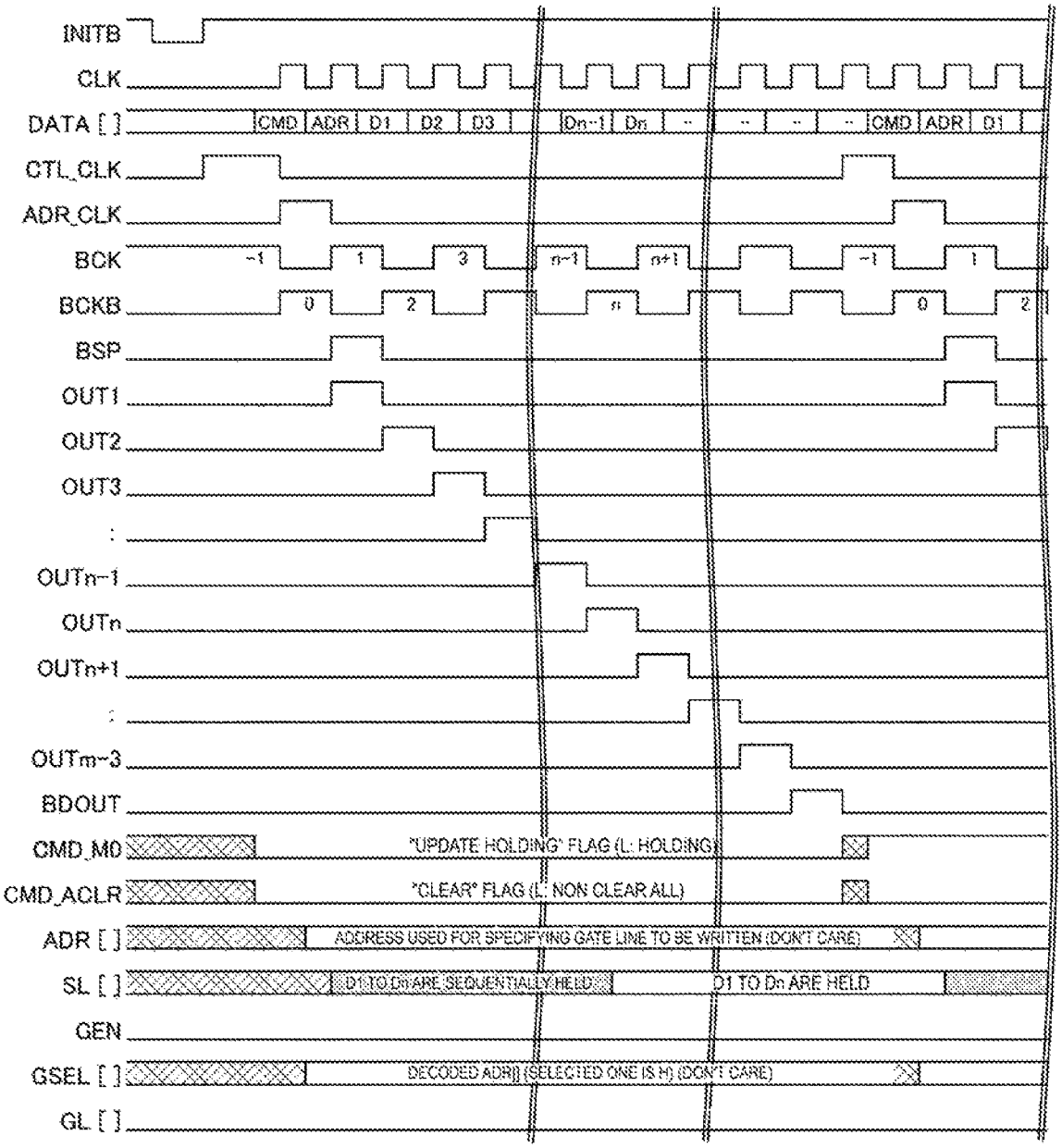
FIG. 20 is a timing chart when the display device according to the related art executes data holding.
Figure 21:
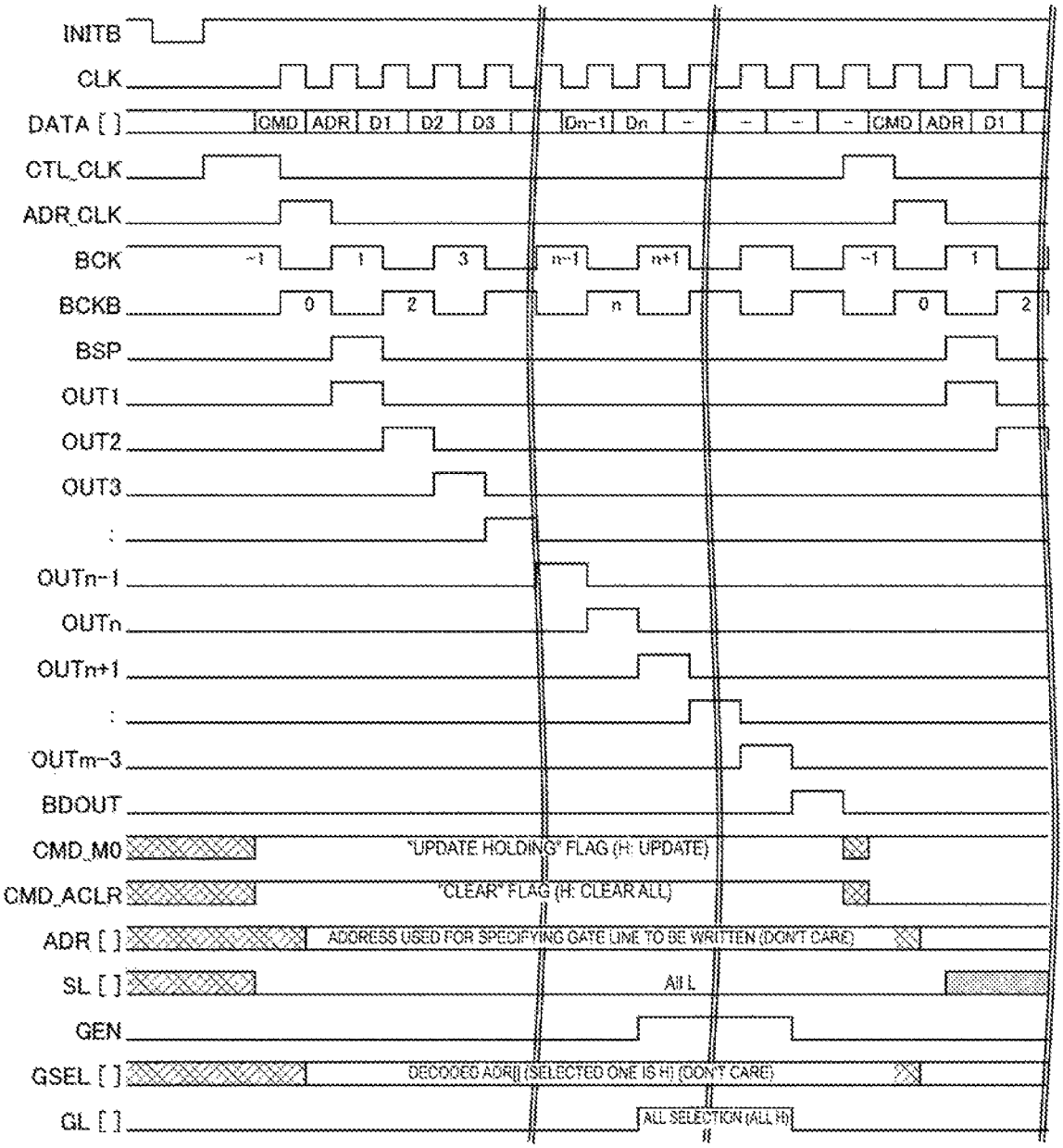
FIG. 21 is a timing chart when the display device according to the related art executes "clear" for all data.

FIG. 19 is a timing chart when the display device 101 according to the related art executes data update. FIG. 20 is a timing chart when the display device 101 according to the related art executes data holding. FIG. 21 is a timing chart when the display device 101 according to the related art executes "clear" for all data. As illustrated in FIGS. 19 to 21, in the display device 101, the clock generation unit 41 outputs the clock signal CTL_CLK between the rising edge of the chip select signal INITB and the rising edge of the first clock signal CLK. In addition, the clock signal ADR_CLK is outputted between the rising edge of the first clock signal CLK and the rising edge of the next clock signal CLK. The timing at which the start pulse signal BSP is outputted is immediately after the output of the clock signal ADR_CLK is completed.

Figure 22A:
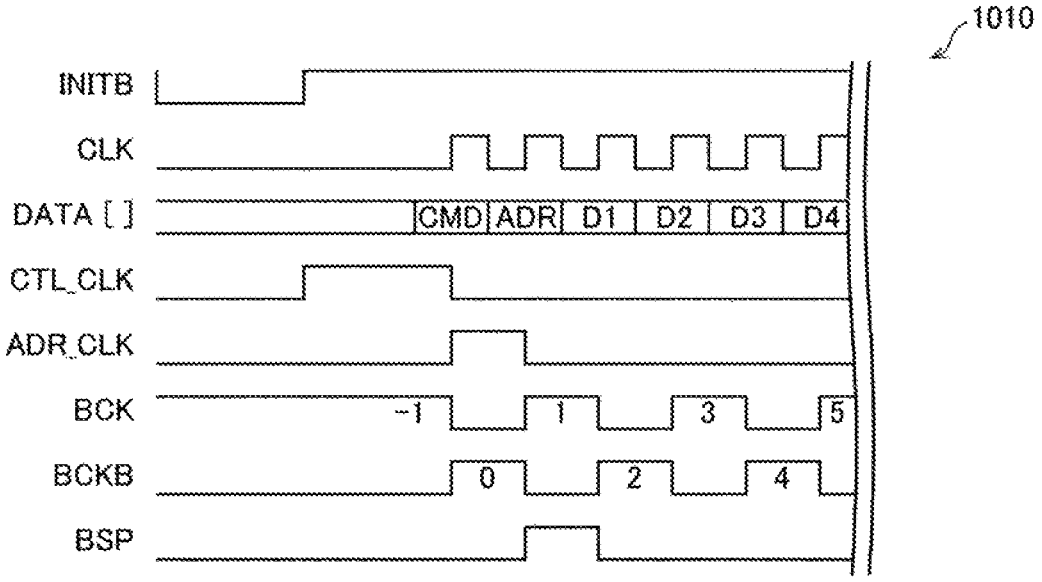
FIG. 22A is a diagram in which a part of the timing chart of the display device according to the related art.
Figure 22B:
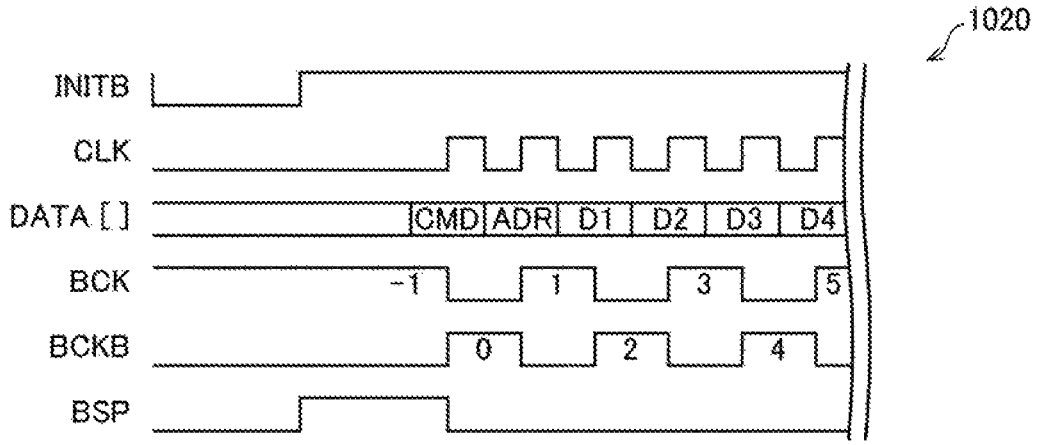
FIG. 22B is a diagram in which a part of the timing chart of the display device according to the first embodiment of the disclosure.

FIGS. 22A and 22B are a diagram in which a part of the timing chart of the display device 101 according to the related art and a part of the timing chart of the display device 1 according to the first embodiment of the disclosure are arranged one above the other. As illustrated in 1010 of FIG. 22A, the display device 101 needs to output the clock signal CTL_CLK and the clock signal ADR_CLK prior to the output of the start pulse signal BSP. As illustrated in 1020 of FIG. 22B, the display device 1 does not need to output the clock signal CTL_CLK and the clock signal ADR_CLK. Further, in the display device 1, the output timing of the start pulse BSP is moved forward as compared with the output timing of the start pulse BSP in the display device 101.

Main Operation and Effect

Unlike the display device 101 of the related art, the display device 1 does not include the latch 142 that individually holds the command data CMD and the latch 143 that individually holds the address data ADR outside the binary driver 13. Accordingly, the timing generator 14 does not need to generate either the dedicated clock signal CTL_CLK that drives the latch 142 or the clock signal ADR_CLK that drives the latch 143. Consequently, unlike the timing generator 114 of the related art, the timing generator 14 only needs to generate the start pulse signal BSP, the clock signal BCK, and the clock signal BCKB for driving the binary driver 13. Thus, the circuit configuration of the timing generator 14 can be simplified as compared with the circuit configuration of the timing generator 114 of the related art. This can reduce the circuit scale and design period of the timing generator 14.

In the display device 1, since the binary driver 13 includes the latch 33 and the latch 34, the circuit scale of the binary driver 13 is increased as compared with the binary driver 113 of the related art. However, the timing generator 14 does not include the circuit 144 for generating the clock signal CTL_CLK and the clock signal ADR_CLK, and the circuit 145 for adjusting the output timing between these clock signals. Accordingly, the circuit scale of the display device 1 as a whole can be reduced as compared with the circuit scale of the display device 101 as a whole. For example, the number of transistors required for the display device 1 can be reduced as compared with the number of transistors required for the display device 101. Further, since the display device 1 does not need to adjust the output timing between the clock signal CTL_CLK and the clock signal ADR_CLK, the design period for such timing adjustment can be reduced.

The structure of the shift registers 31 and the latches 32 to 34 in the display device 1 is the repetitive structure of the shift register 31 and the latches 32 to 34 provided in the binary driver 13. Accordingly, it is easier to optimize the physical circuit wiring line in the display device 1 as compared with the display device 101 having the dedicated latches 142 and 143 according to the related art. Consequently, the physical area of the wiring line region in the display device 1 can be reduced. Further, since the circuit scale of the display device 1 can be reduced, the power consumption of the display device 1 can be reduced, and the frame region of the display device 1 can be reduced. In addition, since it is not necessary to provide the dedicated latches for holding the command data CMD and the address data ADR, respectively, outside the binary driver 13, the design period of these dedicated latches can be reduced.

Second Embodiment

A second embodiment of the disclosure will be described below with reference to FIGS. 23 to 26. Constituent elements having the same functions as the constituent elements described in the first embodiment will be given the same reference signs, and the description thereof will be omitted.

Figure 23:
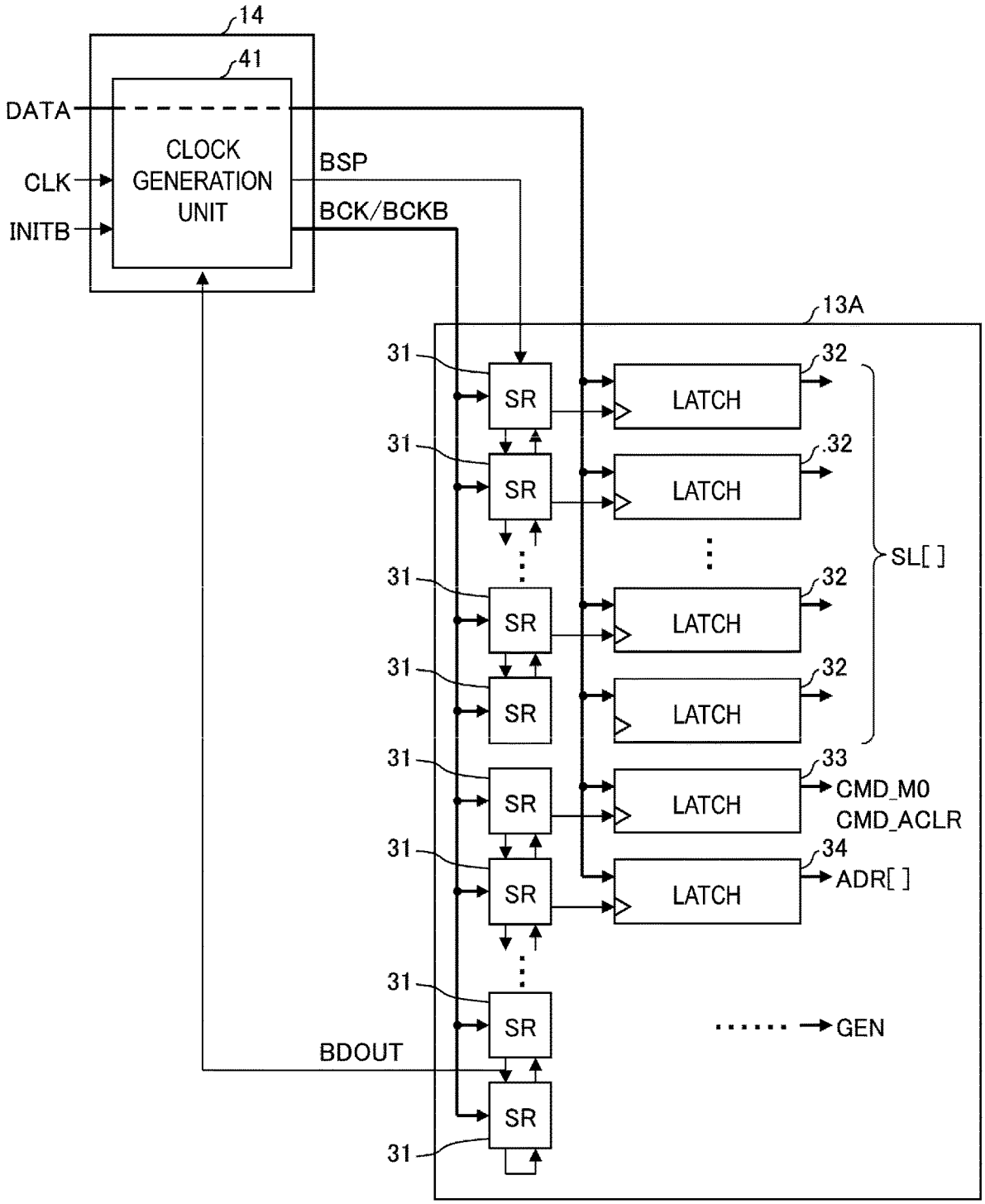
FIG. 23 is a block diagram illustrating a configuration of main portions of a binary driver and the timing generator according to a second embodiment of the disclosure.

FIG. 23 is a block diagram illustrating a configuration of main portions of a binary driver 13A and the timing generator 14 according to the second embodiment of the disclosure. Although not illustrated, a display device 1A according to the present embodiment includes the pixel unit 11, the gate driver 12, the binary driver 13A, and the timing generator 14. The pixel unit 11, the gate driver 12, and the timing generator 14 according to the present embodiment are the same as the pixel unit 11, the gate driver 12, and the timing generator 14 according to the first embodiment, respectively. The binary driver 13A is the same as the binary driver 13 according to the first embodiment in that the binary driver 13A includes the shift registers 31 and the latches 32 to 34. On the other hand, the binary driver 13A differs from the binary driver 13 in that the latch 33 and the latch 34 are arranged in stages behind the latches 32. That is, in the present embodiment, the latch 33 and the latch 34 are incorporated in the binary driver 13A as the latches in the last two stages among the latches in the respective stages in the binary driver 13A.

Figure 24:
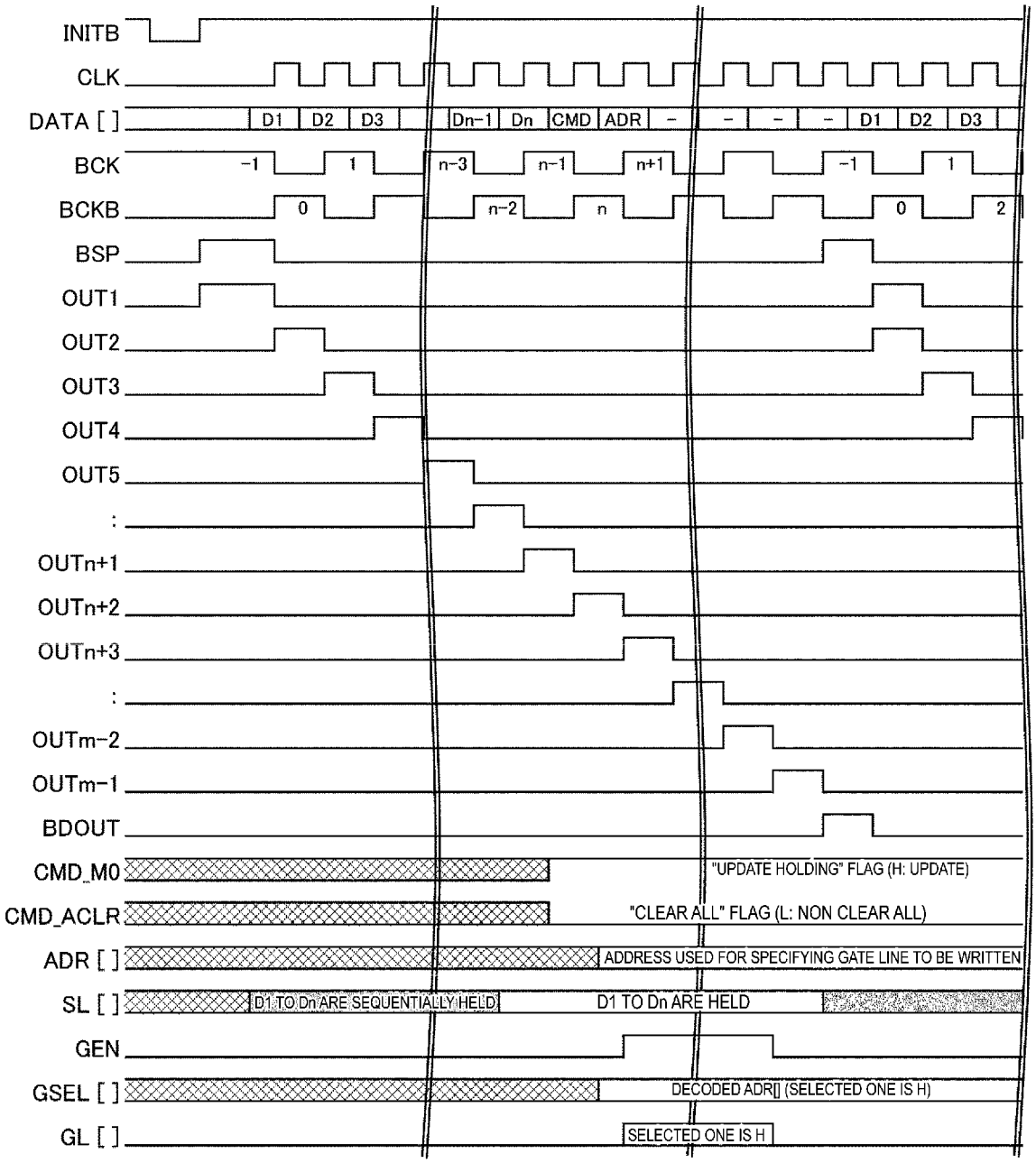
FIG. 24 is a timing chart when a display device according to the second embodiment of the disclosure executes data update.
Figure 25:
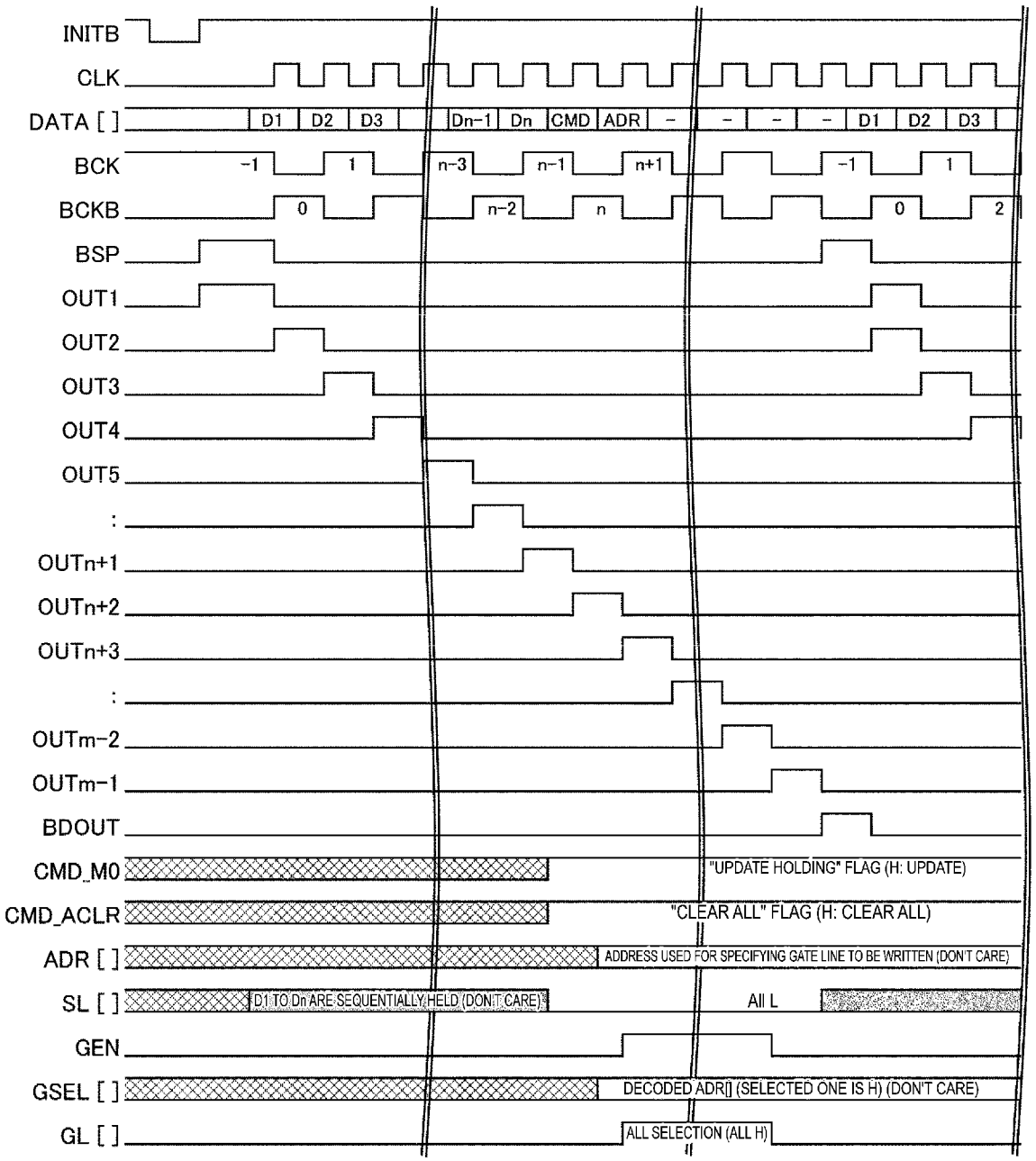
FIG. 25 is a timing chart when the display device according to the second embodiment of the disclosure executes "clear" for all data.
Figure 26:
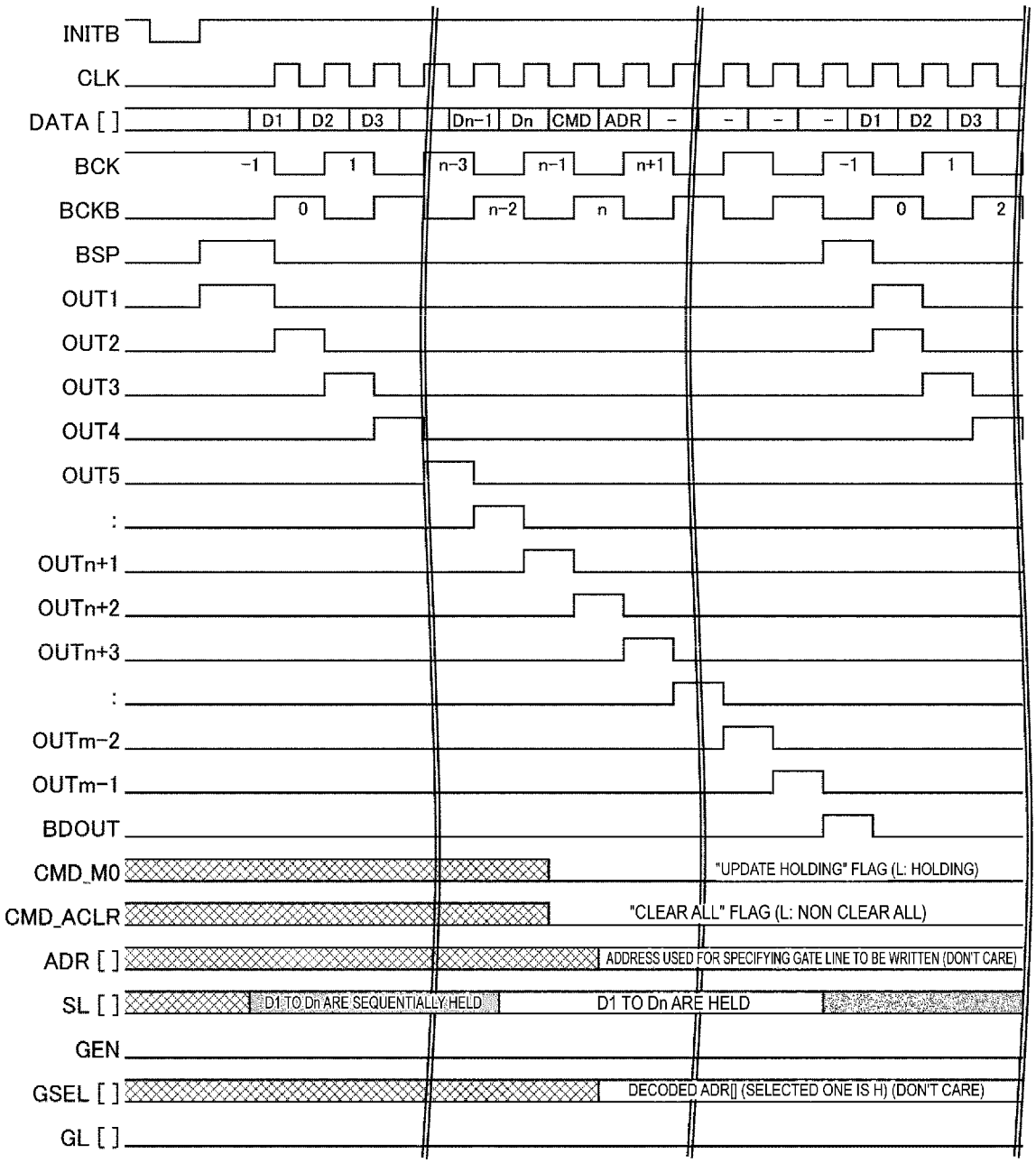
FIG. 26 is a timing chart when the display device according to the second embodiment of the disclosure executes data holding.

FIG. 24 is a timing chart when the display device 1A according to the second embodiment of the disclosure executes data update. FIG. 25 is a timing chart when the display device 1A according to the second embodiment of the disclosure executes "clear" for all data. FIG. 26 is a timing chart when the display device 1A according to the second embodiment of the disclosure executes data holding. As illustrated in FIGS. 24 to 26, in the present embodiment, the timing at which the command data CMD and the address data ADR are fixed and held is delayed as compared with the first embodiment. However, the command data CMD and the address data ADR are fixed and held by the timing at which these data are utilized. That is, the holding of the command data CMD and the holding of the address data ADR are confirmed between the timing at which the update or holding of the image data D1 to Dn is determined and the timing at which the gate signal GL has the H value and the image data D1 to Dn are written. Accordingly, the display device 1A according to the present embodiment can execute the same operation as the display device 1 according to the first embodiment. In this manner, as long as the period for using the data signal DATA and the command data CMD is within the period for which the data signal DATA and the command data CMD are held, the positions in which the latch 33 and the latch 34 are incorporated in the binary driver 13A are not particularly limited.

In the display device 1A, the positions where the latch 33 and the latch 34 are incorporated in the binary driver 13A are different from those in the display device 1. However, the display device 1A is the same as the display device 1 in that the latch 33 and the latch 34 are incorporated in the binary driver 13A. That is, similar to the display device 1, it is not necessary to provide, outside the binary driver 13A, the latch 142 that individually holds the command data CMD and the latch 143 that individually holds the address data ADR. Accordingly, the timing generator 14 does not need to generate either the dedicated clock signal CTL_CLK that drives the latch 142 or the clock signal ADR__CLK that drives the latch 143. Consequently, unlike the timing generator 114 of the related art, the timing generator 14 only needs to generate the start pulse signal BSP, the clock signal BCK, and the clock signal BCKB for driving the binary driver 13A. Thus, the circuit configuration of the timing generator 14 can be simplified as compared with the circuit configuration of the timing generator 114 of the related art. This can reduce the circuit scale and design period of the timing generator 14.

In the display device 1A, since the binary driver 13A includes the latch 33 and the latch 34, the circuit scale of the binary driver 13A is increased as compared with the binary driver 113 of the related art. However, the timing generator 14 does not include the circuit 144 for generating the clock signal CTL_CLK and the clock signal ADR_CLK, and the circuit 145 for adjusting the output timing between these clock signals. Accordingly, the circuit scale of the display device 1A as a whole can be reduced as compared with the circuit scale of the display device 101 as a whole. For example, the number of transistors required for the display device 1A can be reduced as compared with the number of transistors required for the display device 101. Further, since the display device 1A does not need to adjust the output timing between the clock signal CTL_CLK and the clock signal ADR_CLK, the design period for such timing adjustment can be reduced.

Third Embodiment

A third embodiment of the disclosure will be described below with reference to FIGS. 27 to 31. Constituent elements having the same functions as the constituent elements described in the first and second embodiments will be given the same reference signs, and the description thereof will be omitted.

Figure 27:
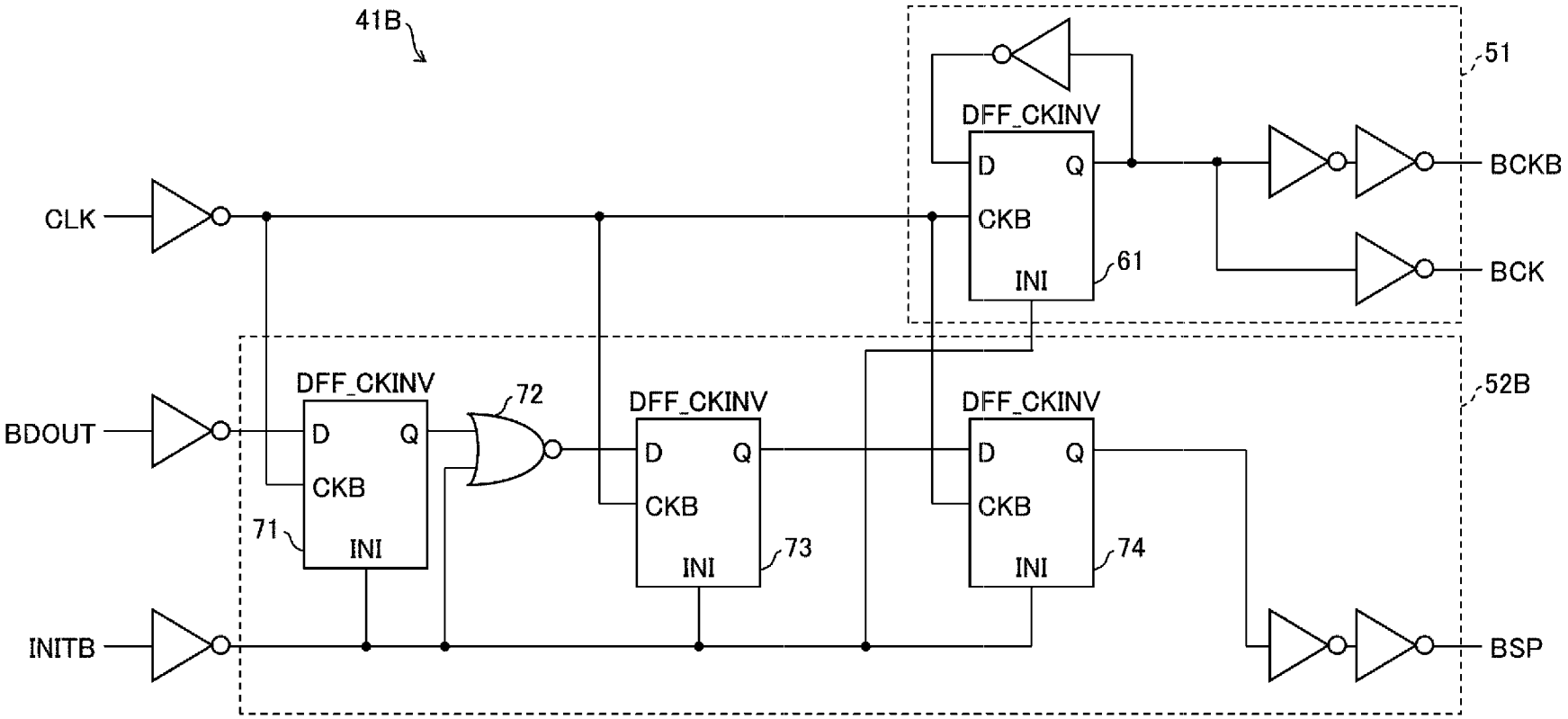
FIG. 27 is a diagram illustrating an example of a circuit configuration of a clock generation unit according to a third embodiment of the disclosure.

FIG. 27 is a diagram illustrating an example of a circuit configuration of a clock generation unit 41B according to the third embodiment of the disclosure. Although not illustrated, a display device 1B according to the present embodiment includes the pixel unit 11, the gate driver 12, the binary driver 13, and a timing generator 14B. Although not illustrated, the timing generator 14B includes the clock generation unit 41B.

As illustrated in FIG. 27, the clock generation unit 41B includes the functional portion 51 and a functional portion 52B. The functional portion 51 is a portion for generating the clock signal BCK and the clock signal BCKB for the binary driver 13. The configuration of the functional portion 51 is the same as that of the first embodiment. The functional portion 52B is a portion at which the start pulse BSP for the binary driver 13 is generated. As illustrated in FIG. 27, the functional portion 52B has a configuration in which the circuit 144 for generating the clock signal CTL_CLK and the clock signal ADR_CLK according to the related art is added to the clock generation unit 31 according to the first embodiment. Specifically, the functional portion 52B includes a flip-flop 71, a logic circuit 72, a flip-flop 73, and a flip-flop 74. The flip-flop 71 and the logic circuit 72 correspond to the portion at which the clock signal CTL_CLK is generated in the related art. The flip-flop 73 corresponds to the portion at which the clock signal ADR_CLK is generated in the related art. The flip-flop 74 corresponds to the portion at which the start pulse BSP is generated in the related art.

Figure 28:
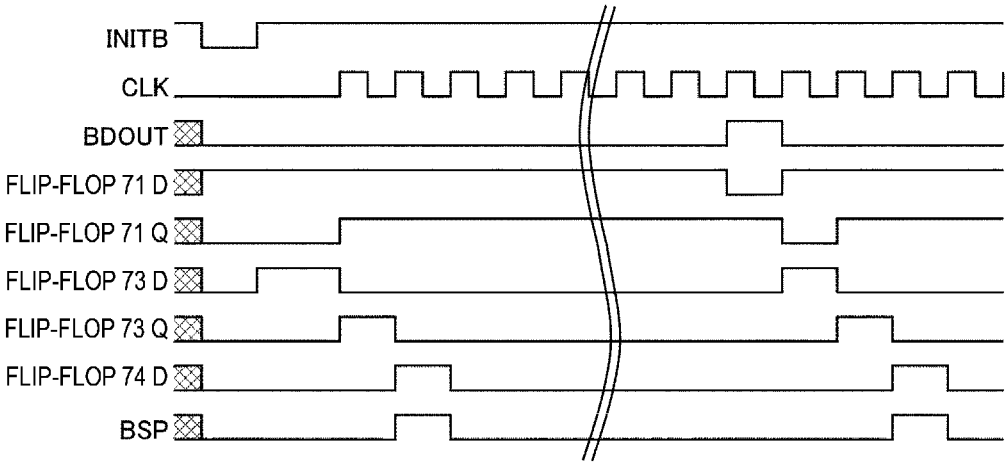
FIG. 28 is a timing chart illustrating an operation of the clock generation unit according to the third embodiment of the disclosure.

FIG. 28 is a timing chart illustrating an operation of the clock generation unit 41B according to the third embodiment of the disclosure. An inverted signal of the signal BDOUT is inputted to an input D of the flip-flop 71. While the chip select signal INITB is not selected (L value) and until the rise of the first clock signal CLK after the chip select signal INITB is selected, the flip-flop 71 outputs a signal with the L value from an output Q. The flip-flop 71 also outputs the signal with the L value from the output Q while the signal BDOUT has the H value. The logic circuit 72 is valid only when the signal outputted from the output Q of the flip-flop 71 has the L value and the chip select signal INITB has the H value, and generates a signal with the H value. The logic circuit 72 outputs the generated signal with the H value to an input D of the flip-flop 73. The flip-flops 73 and 74 execute the shifting operations at the rising edge of the clock signal CLK. The clock generation unit 41B finally outputs a signal outputted from an output Q of the flip-flop 74 to the outside of the clock generation unit 41B as the start pulse BSP.

Figure 29:
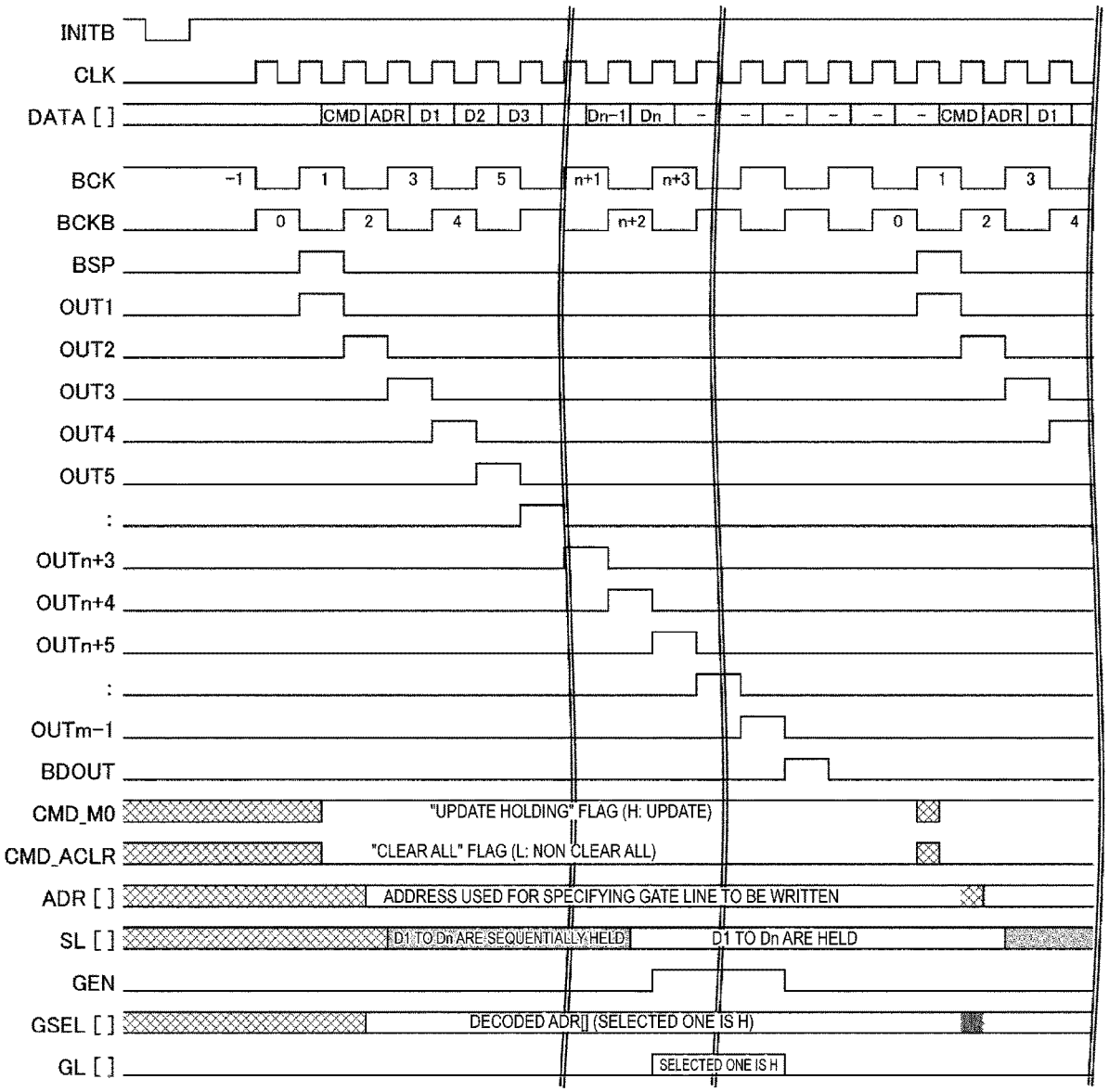
FIG. 29 is a timing chart when a display device according to the third embodiment of the disclosure executes data update.
Figure 30:
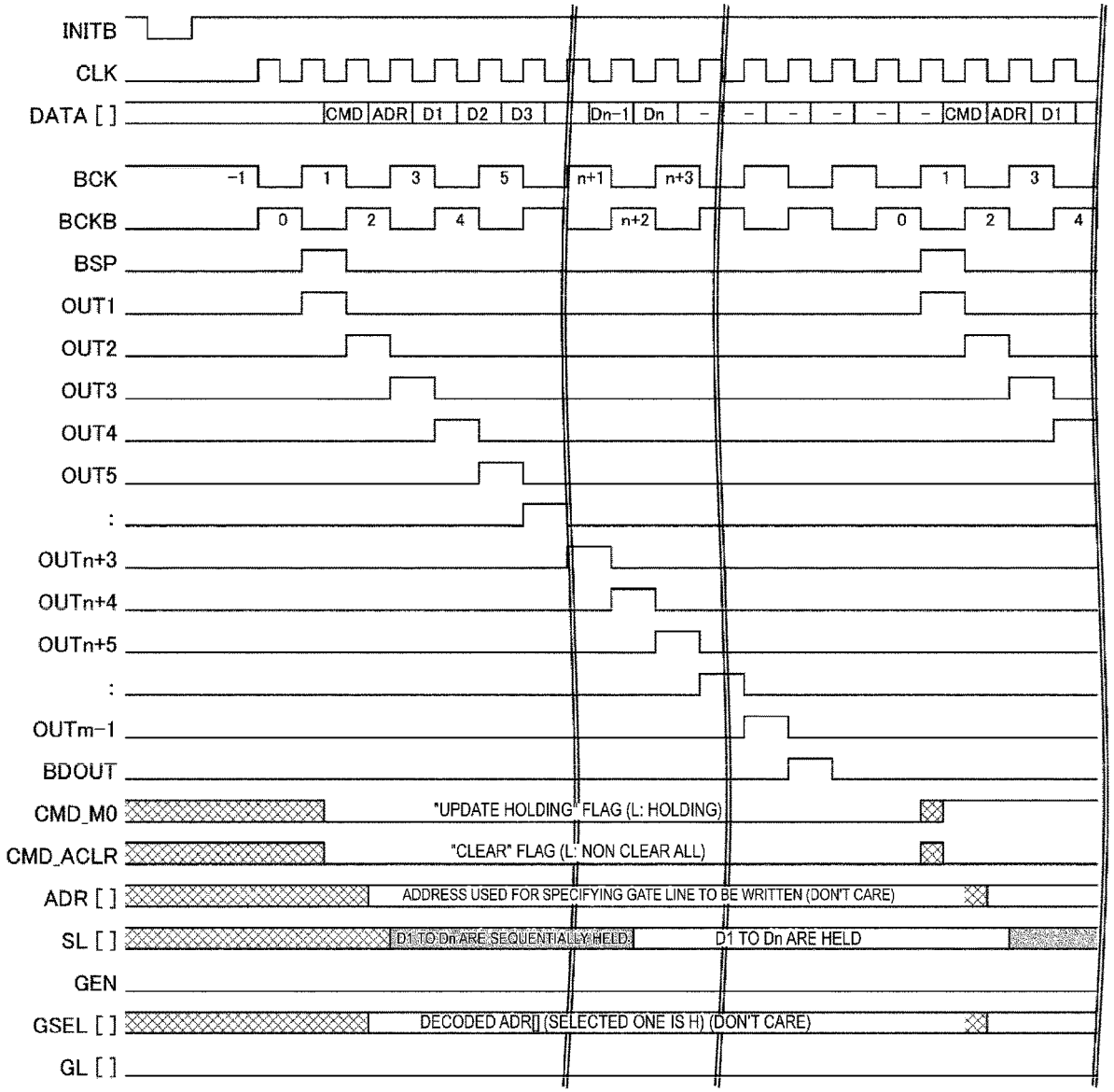
FIG. 30 is a timing chart when the display device according to the third embodiment of the disclosure executes data holding.
Figure 31:
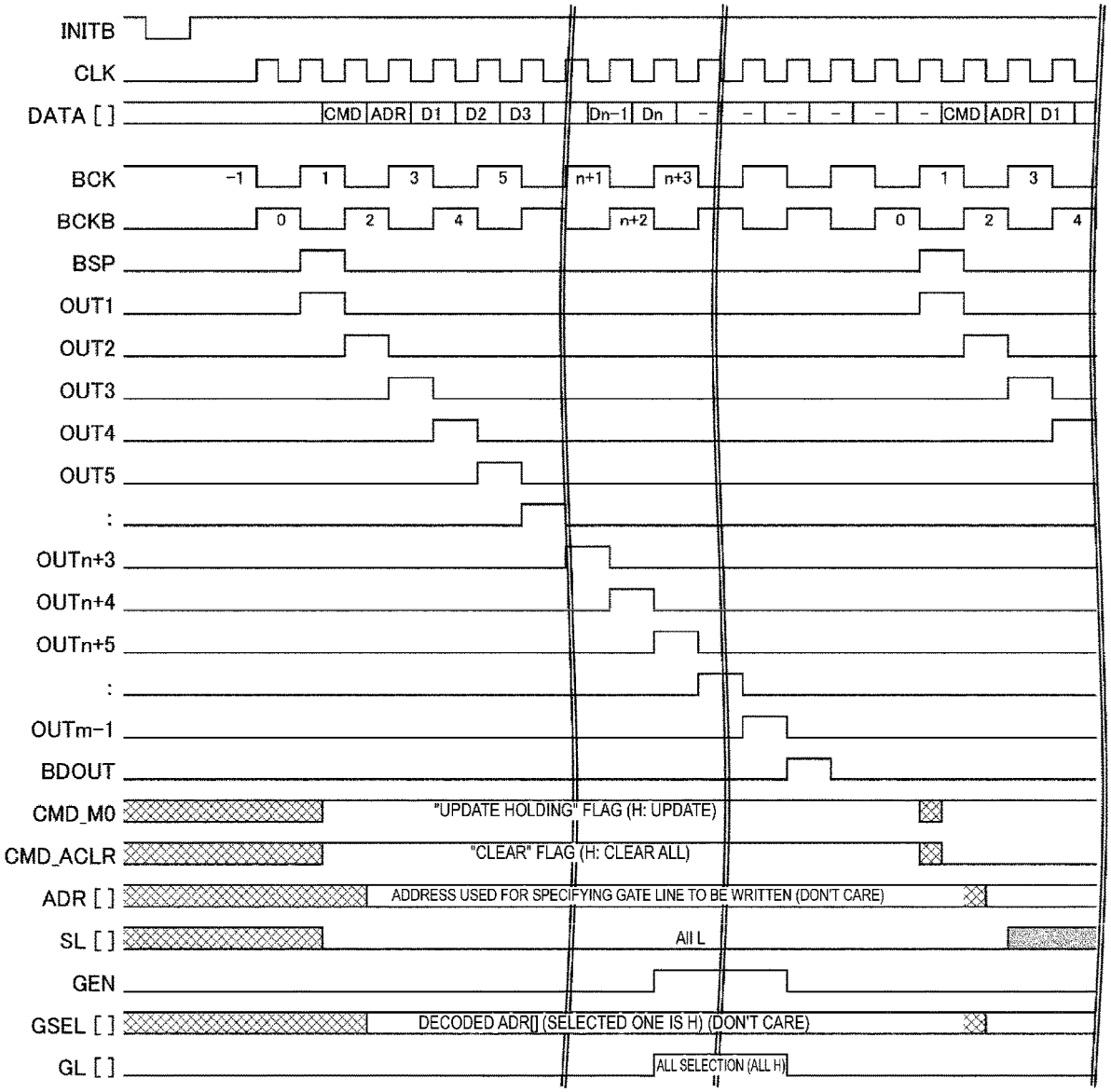
FIG. 31 is a timing chart when the display device according to the third embodiment of the disclosure executes "clear" for all data.

FIG. 29 is a timing chart when the display device 1B according to the third embodiment of the disclosure executes data update. FIG. 30 is a timing chart when the display device 1B according to the third embodiment of the disclosure executes data holding. FIG. 31 is a timing chart when the display device 1B according to the third embodiment of the disclosure executes "clear" for all data. As illustrated in FIGS. 29 to 31, in the present embodiment, the input timing of the data signal DATA is delayed as compared with the first embodiment. Thus, even when the start pulse BSP is outputted at the same timing as the display device 101 according to the related art, the latch 33 and the latch 34 can be incorporated in the first two stages in the binary driver 13 as in the first embodiment. As described above, in the present embodiment, the latch 33 and the latch 34 can be provided in the binary driver 13 without moving forward the output timing of the start pulse BSP.

In the display device 1B, the positions where the latch 33 and the latch 34 are incorporated in the binary driver 13 are the same as those in the display device 1 according to the first embodiment. In other words, in the display device 1B, similar to the display device 1 according to the first embodiment, it is not necessary to provide, inside the timing generator 143, the latch 142 that individually holds the command data CMD and the latch 143 that individually holds the address data ADR. In the timing generator 14B, unlike the timing generator 14 according to the first embodiment, a circuit 44 corresponding to the circuit 144 according to the related art is provided in the clock generation unit 41B. Consequently, the circuit scale of the timing generator 14B is larger than the circuit scale of the timing generator 14 according to the first embodiment. However, the clock generation unit 41B does not need to output the dedicated clock signal CTL_CLK for driving the latch 142 and the clock signal ADR_CLK for driving the latch 143 to the latch 142 and the latch 143, respectively. Accordingly, the clock generation unit 41B does not need to include the circuit 145 to adjust the output timing between these clocks. Consequently, unlike the timing generator 114 of the related art, the timing generator 14B only needs to generate the start pulse signal BSP, the clock signal BCK, and the clock signal BCKB for driving the binary driver 13. Thus, the circuit configuration of the timing generator 14B can be simplified as compared with the circuit configuration of the timing generator 114 of the related art. This can reduce the circuit scale and design period of the timing generator 14B.

In the display device 1B, since the binary driver 13 includes the latch 33 and the latch 34, the circuit scale of the binary driver 13 is increased as compared with the binary driver 113 of the related art. However, the timing generator 14B does not include the circuit 145 for adjusting the output timing between the clock signal CTL_CLK and the clock signal ADR_CLK. Accordingly, the circuit scale of the display device 1B as a whole can be reduced as compared with the circuit scale of the display device 101 as a whole. For example, the number of transistors required for the display device 1B can be reduced as compared with the number of transistors required for the display device 101. Further, since the display device 1B does not need to adjust the output timing between the clock signal CTL_CLK and the clock signal ADR_CLK, the design period for such timing adjustment can be reduced.

Supplement

A display device according to a first aspect of the disclosure, which is an active matrix display device configured to receive a data signal including image data and other data different from the image data, has a configuration including a pixel unit including a memory configured to store the image data, a binary driver including a first holding circuit configured to hold the image data and at least one second holding circuit configured to hold the other data, and a timing generator configured to generate a drive signal used for driving the binary driver.

The display device according to a second aspect of the disclosure may have a configuration in which, in the first aspect, the timing generator generates a start pulse for the binary driver between a timing at which a chip select signal is outputted, and a timing at which a first clock signal outputted after the chip select signal is outputted.

The display device according to a third aspect of the disclosure may have a configuration in which, in the first or second aspect, a data width of the data signal and a data width of the binary driver are different.

The display device according to a fourth aspect of the disclosure may have a configuration in which, in any one of the first to third aspects, the second holding circuit is arranged in a stage before the first holding circuit.

The display device according to a fifth aspect of the disclosure may have a configuration in which, in any one of the first to third aspects, the second holding circuit is arranged in a stage behind the first holding circuit.

The display device according to a sixth aspect of the disclosure may have a configuration, in any one of the first to fifth aspects, in which the other data is address data used for specifying a line in which the image data is written, and the second holding circuit generates an address signal by using the address data, and further including a gate driver configured to generate a gate signal by binary decoding the address signal.

The display device according to an seventh aspect of the disclosure may have a configuration in which, in any of the first to fifth aspects, the other data is command data used for specifying any one of an update operation, a holding operation, and a "clear all" operation of the image data.

Additional Items

The disclosure is not limited to each of the embodiments described above, and various modifications may be made within the scope of the claims. Embodiments obtained by appropriately combining technical approaches disclosed in each of the different embodiments also fall within the technical scope of the disclosure. Furthermore, novel technical features can be formed by combining the technical approaches disclosed in the embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A display device that is an active matrix display device configured to receive a data signal including image data and other data different from the image data, the display device comprising:

a pixel unit including a memory configured to store the image data;

a gate driver configured to supply a gate signal to the pixel unit;

a binary driver including a first holding circuit configured to hold the image data and at least one second holding circuit configured to hold the other data that is outputted to the gate driver; and a timing generator configured to generate a drive signal used for driving the binary driver.

2. The display device according to claim 1, wherein the timing generator generates a start pulse for the binary driver between a timing at which a chip select signal is outputted, and a timing at which a first clock signal is outputted after the chip select signal is outputted.

3. The display device according to claim 1, wherein a data width of the data signal and a data width of the binary driver are different.

4. The display device according to claim 1, wherein the other data is address data used for specifying a line in which the image data is written, the at least one second holding circuit generates an address signal by using the address data, and the gate driver is configured to generate the gate signal by binary decoding the address signal.

5. The display device according to claim 1, wherein the other data is command data used for specifying any one of an update operation, a holding operation, and a "clear all" operation of the image data.

6. A display device according to claim 1, that is an active matrix display device configured to receive a data signal including image data and other data different from the image data, the display device comprising:

a pixel unit including a memory configured to store the image data;

a binary driver including a first holding circuit configured to hold the image data and at least one second holding circuit configured to hold the other data; and a timing generator configured to generate a drive signal used for driving the binary driver, wherein the at least one second holding circuit is arranged in a stage before the first holding circuit.

7. The display device according to claim 6, wherein the timing generator generates a start pulse for the binary driver between a timing at which a chip select signal is outputted, and a timing at which a first clock signal is outputted after the chip select signal is outputted.

8. The display device according to claim 6, wherein a data width of the data signal and a data width of the binary driver are different.

9. The display device according to claim 6, wherein the other data is address data used for specifying a line in which the image data is written, and the at least one second holding circuit generates an address signal by using the address data, the display device further including:

a gate driver configured to generate a gate signal by binary decoding the address signal.

10. The display device according to claim 6, wherein wherein the other data is command data used for specifying any one of an update operation, a holding operation, and a "clear all" operation of the image data.

11. A display device that is an active matrix display device configured to receive a data signal including image data and other data different from the image data, the display device comprising:

a pixel unit including a memory configured to store the image data;

a binary driver including a first holding circuit configured to hold the image data and at least one second holding circuit configured to hold the other data; and a timing generator configured to generate a drive signal used for driving the binary driver, wherein the at least one second holding circuit is arranged in a stage behind the first holding circuit.

12. The display device according to claim 11, wherein the timing generator generates a start pulse for the binary driver between a timing at which a chip select signal is outputted, and a timing at which a first clock signal is outputted after the chip select signal is outputted.

13. The display device according to claim 11, wherein a data width of the data signal and a data width of the binary driver are different.

14. The display device according to claim 11, wherein the other data is address data used for specifying a line in which the image data is written, and the at least one second holding circuit generates an address signal by using the address data, the display device further including:

a gate driver configured to generate a gate signal by binary decoding the address signal.

15. The display device according to claim 11, wherein wherein the other data is command data used for specifying any one of an update operation, a holding operation, and a "clear all" operation of the image data.

* * * * *